United States Patent [19]

Brandenburg et al.

[11] Patent Number: 4,939,862

[45] Date of Patent: Jul. 10, 1990

[54] METHOD AND APPARATUS FOR ORIENTING AND LOADING CARTRIDGES

[75] Inventors: Ernest Brandenburg, Dallas, Tex.; M. Gaines Chesnut, Kremmling, Colo.

[73] Assignee: Ram-Line, Inc., Golden, Colo.

[21] Appl. No.: 117,247

[22] Filed: Nov. 5, 1987

Related U.S. Application Data

[63] Continuation-in-part of Ser. No. 902,888, Sep. 2, 1986, Pat. No. 4,739,572.

[51] Int. Cl.[5] ..... F41A 9/66

[52] U.S. Cl. ..... 42/88; 42/87

[58] Field of Search ..... 42/87, 88

[56] References Cited

U.S. PATENT DOCUMENTS

| | | | |
|---|---|---|---|
| 1,786,537 | 12/1930 | Holek | 42/87 |
| 2,451,521 | 10/1948 | Uglum | 42/87 |
| 2,542,842 | 2/1951 | Saunders | 42/87 |
| 3,242,609 | 3/1966 | Koistinen | 42/87 |
| 4,574,511 | 3/1986 | Csonger | 42/87 |
| 4,706,402 | 11/1987 | Csonger | 42/87 |
| 4,720,931 | 1/1988 | Jensen | 42/87 |
| 4,739,572 | 4/1988 | Brandenburg | 42/87 |

*Primary Examiner*—Charles T. Jordan

*Attorney, Agent, or Firm*—Sheridan, Ross & McIntosh

[57] ABSTRACT

A method and an apparatus for orienting and loading a plurality of unoriented rim-fire cartridge into a magazine are provided. An orienter apparatus employs gravity to orient rim-fire cartridges by hanging a plurality of cartridges from a number of parallel rails. The orienter is repositioned to a second or vertical configuration so that gravity can be used to feed the columns of oriented cartridges through a chute. In another embodiment, a collector apparatus is used to pick up a plurality of cartridges and hold the cartridges in a holding portion. The orienter or collector operatively engages with a loader which employs a camming mechanism to move cartridges one at a time into a magazine. The cartridges are placed in a first angular relationship with respect to the magazine opening and are moved through the opening while changing the angular relationship of the cartridge with the magazine opening. In another embodiment for use with, for example, 9 millimeter cartridges, a cartridge moving means is used to move cartridges, one at a time, as provided in single file by collector or orientor. The moving means moves a cartridge in a first direction towards the open end of the magazine and then in a second direction into the open end of the magazine.

14 Claims, 15 Drawing Sheets

METHOD AND APPARATUS FOR ORIENTING AND LOADING CARTRIDGES

RELATED APPLICATION

This application is a continuation-in-part of commonly-assigned application Ser. No. 902,888, filed Sept. 2, 1986, now U.S. Pat. No. 4,739,572.

FIELD OF THE INVENTION

The present invention relates to a method and an apparatus for loading cartridges into a magazine and, in particular, to a method and apparatus for orienting or collecting a plurality of cartridges and loading the oriented or collected cartridges into a magazine.

BACKGROUND INFORMATION

A number of types of firearms can be used in conjunction with magazines for holding cartridges to assist in feeding the cartridges into the firearm. When the magazines are designed to be reusable, the depleted magazines must be reloaded with cartridges. Many reusable magazines can be reloaded by hand without the use of any apparatus. However, hand reloading is often slow and tedious so that it is useful to provide an apparatus for assisting in the reloading process. A number of characteristics of cartridges and magazines present problems which a useful reloading apparatus must solve.

Cartridges are produced in a variety of configurations including center-fire cartridges which are typically in the shape of a cylinder with a rounded or pointed end and rim-fire cartridges, i.e. cartridges which have a generally cylindrical body portion but also have a rim of a larger diameter than the body diameter. Rim-fire cartridges are somewhat more difficult to store, handle, and load because the cartridges do not stack in a regular or linear fashion as center-fire cartridges do. Thus, devices for assisting in loading cartridges into magazines preferably should be able to accommodate a variety of cartridge shapes and, particularly, should be capable of accommodating rim-fire cartridges.

Cartridges are often sold packaged in an unoriented manner, i.e. in which the longitudinal axes of the cartridges are not substantially parallel or coplanar with each other. Because a cartridge magazine requires that the cartridges be positioned in an oriented fashion, a useful apparatus for loading should both provide for orienting the cartridges and then placing the oriented cartridges into the magazine.

Certain magazines require that cartridges be positioned into the magazine in a particular manner. Specifically, magazines for use with rim-fire cartridges often require that the cartridges be (1) inserted into the magazine one-at-a-time, i.e. such that the cartridge which is being inserted into the magazine moves in a direction or at an angle different from the direction or angle of subsequent cartridges which are to be placed into the magazine and/or (2) that the cartridges be positioned into the magazine by first placing the cartridge at a first angle with respect to the magazine opening and then moving or pushing the cartridge while changing the angle to a second angle with respect to the magazine opening. A useful loading apparatus thus should be capable of a configuration which will result in a one-at-a-time and/or multiple angle insertion of cartridges.

The oriented cartridges supplied to the loader apparatus should be in a column of sufficient number that the loading into magazines can be performed efficiently without unnecessary interruptions. However, a device for holding a single column of a large number of cartridges results in an awkward and unwieldy apparatus. Thus, it is useful to provide a cartridge orienting and loading method and apparatus which supplies a column of cartridges in a large number but without being of cumbersome dimensions.

Because a loading mechanism may be used in field or outdoor conditions, devices which depend upon springs or motors are subject to freezing from exposure to cold and/or corrosion or deterioration from exposure to water and the like. Thus, it is advantageous to provide a device which orients cartridges and can be used for loading cartridges but which does not require a motor or springs to orient or move the cartridges.

SUMMARY OF THE INVENTION

The present invention relates to a method and apparatus for orienting a plurality of unoriented cartridges and loading the oriented cartridges into a magazine. The apparatus can be provided in an integral configuration, but is preferably formed of two detachable portions, an orienting portion and a loading portion. The orienting portion is designed to use gravity to orient a plurality of unoriented rim-fire cartridges using a number of rails. The rails are spaced apart farther than the body diameter of the cartridges but less than the rim diameter. In this manner, when cartridges are placed adjacent to the rails, the nose portion of the cartridges, being heavier than the rim-end, will tilt or move downward between the rails. The cartridges will thus be hung from the rails by portions of their rims with the heavy nose-portion of the cartridges pointing down. In this configuration, the cartridges will be substantially parallel with each other, i.e. with the longitudinal axes of the cartridges all substantially parallel with each other. This orienting of the cartridges may require that the orienting device be shaken. The device preferably contains more than two rails, preferably in substantially parallel configuration so that the bullets are oriented into a number of columns.

After the cartridges are oriented, the orienting portion is up-ended or moved to a second position so that the oriented cartridges move in a direction perpendicular to their longitudinal axes to form one or more columns of adjacent cartridges. The force of gravity is then used to move the cartridges down a chute towards an opening in the orienting portion. When two or more columns of cartridges are provided, a gate is used to direct each column, in turn, towards the chute. The opening at the bottom of the chute is controlled using a latch mechanism to prevent the cartridges from leaving the orienting portion prematurely.

In another embodiment, cartridges are collected by a collector apparatus into a holding portion of the collector apparatus. The collector apparatus has a latch partly covering an open end. When the collector is positioned over a cartridge and pushed down onto the cartridge, the latch is opened permitting the cartridge to pass through the open end and into the holding portion. A number of cartridges can be collected in this way and held in an oriented condition in the holding portion.

The orienting or collecting portion is then connected to the loading portion which contains an area for receiving the orienting or collecting portion. A latch-activating cam on the loading portion opens the latch so that a first cartridge falls, under the force of gravity, into a cartridge receiving device on the loading portion. An empty or partly empty magazine is inserted in a magazine receiving area of the loading portion. The magazine receiving area is configured to hold the opening of the magazine in a predetermined position with respect to the cartridge receiving device.

The cartridge receiving device is movable and is attached to a mechanism such as a cam mechanism which controls the movement of the cartridge receiving device. The camming mechanism for moving the cartridge receiving device is configured to move the cartridge through the opening of the magazine and into the magazine in a manner which is consistent with the loading requirements of the particular magazine. For rim-fire cartridges, the cartridge is initially guided by movement of the cartridge rim through a rim receiving slot. The cartridge is placed in a first angular relationship with respect to the magazine opening and the rim portion is inserted through the opening. The cartridge is then moved to change the angular relationship to a second angle with respect to the magazine opening as the remainder of the cartridge is inserted through the magazine opening and into the magazine. The camming mechanism is then returned to its original position to permit the next cartridge to enter the cartridge receiving device. In this manner, the cartridges are loaded into the magazine one at a time.

In a second embodiment, a cartridge moving means moves a cartridge in a first direction to position the cartridge below the plane passing through the magazine open end retaining lips and then moves the cartridge in a second direction into the open end of the magazine under the retaining lips. Unlike the first embodiment, the cartridge moving means does not substantially change the angular relationship of the cartridge to the magazine during insertion. The cartridge is preferably first moved approximately parallel to the longitudinal axis of the magazine and then, without the moving means changing the angular relationship of the cartridge to the magazine, the cartridge is moved approximately perpendicular to the magazine longitudinal axis. Although there may be some change in angular relationship during this process, such change is not caused by the cartridge moving means but such deviation is caused by, for example, interaction of the cartridge with the magazine follower or with other cartridges in the magazine.

As can be appreciated, the present invention provides a number of advantages. The invention is able to accommodate rim-fire cartridges to assist in orienting and loading such cartridges. The invention permits orienting cartridges which are packaged in an unoriented fashion. The invention is compatible with the requirements of a number of magazine loading techniques including one-at-a-time loading, loading by changing the angle of the cartridge as it is inserted and loading without changing the angle. By providing for a loader which is detachable from the orienter or collector, the loader can be fixed or held for one-handed operation. The orienter or collector can be used elsewhere for orienting or collecting cartridges. A loaded magazine can be removed and an empty magazine can be attached to the loader without separating the loader from its support. The orienting and movement of the cartridges through the chute is entirely gravity-powered and does not require use of a motor or springs. By providing a gate for controlling movement of cartridges, the benefits of providing a larger number of cartridges in columnar form are provided without the cumbersome dimensions required by a single column device.

DETAILED DESCRIPTION OF THE PREFERRED EMBODIMENT

Figure 1:
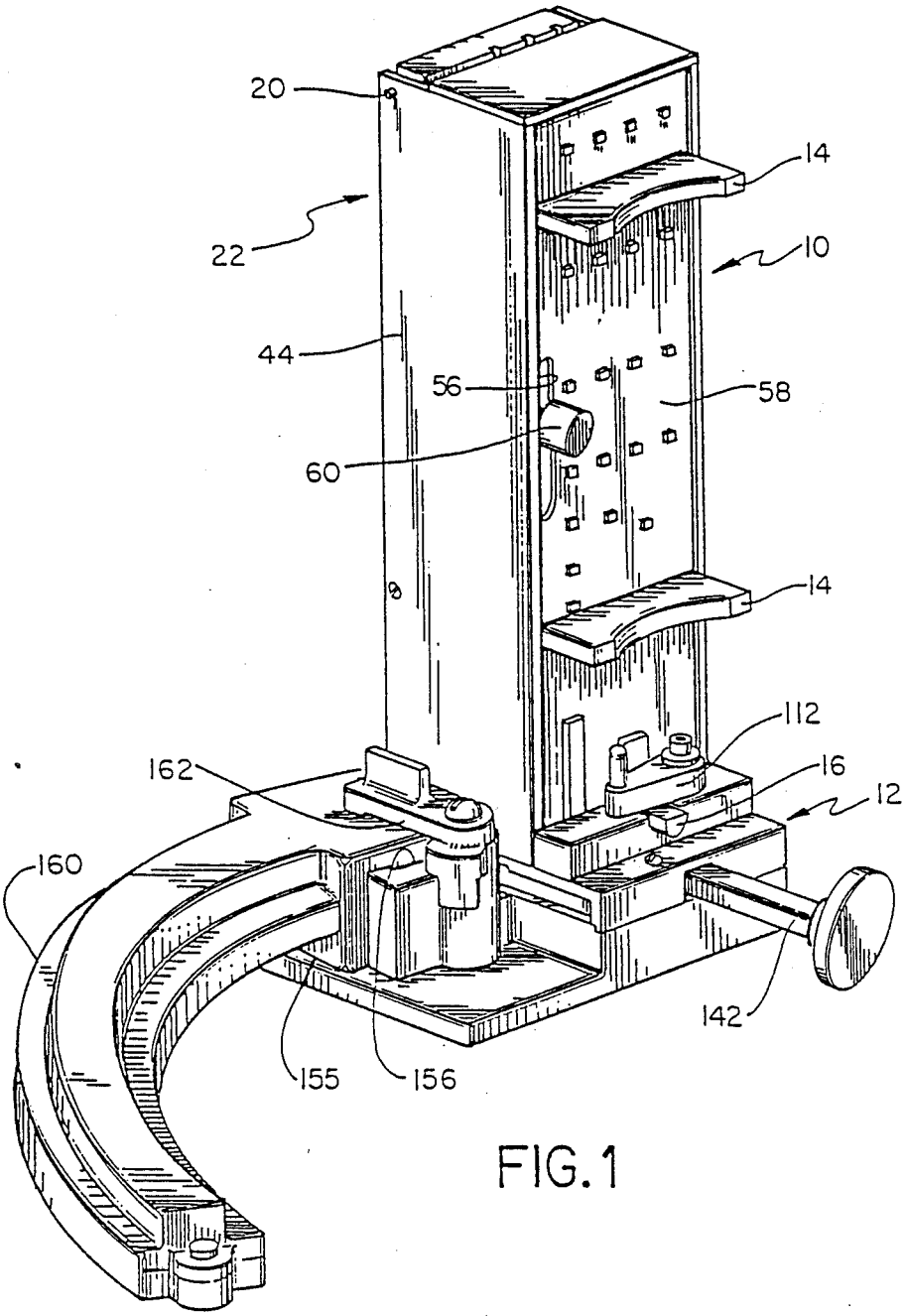
FIG. 1 is a perspective view of the loader portion engaged with the orienter portion and with a magazine positioned in the magazine receiving area.
Figure 9:
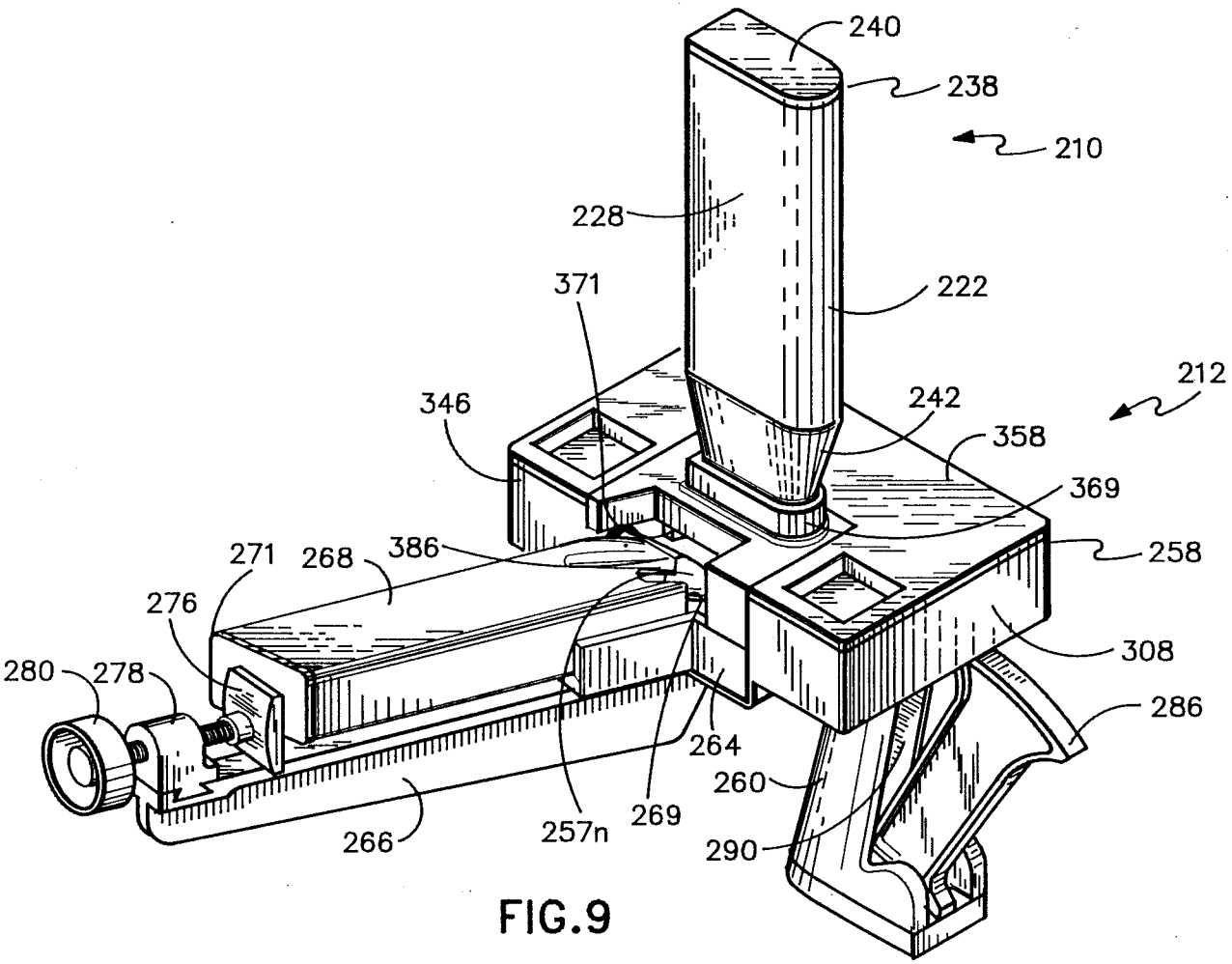
FIG. 9 is a perspective view of a second embodiment of the invention in which a loader is engaged with a collector and with a magazine positioned in the magazine receiving area.

The present invention relates to a method and an apparatus for orienting a plurality of unoriented cartridges and loading the cartridges into a magazine. Although the orienter and loader can be provided as an integral device, in the preferred embodiment, as best seen in FIG. 1, the orienter 10 is detachably engaged with the loader 12. The present invention also relates to a method and an apparatus for collecting a plurality of cartridges and loading the collected cartridges into a magazine. As best seen in FIG. 9, preferably a collector 210 is detachably engaged with a loader 212.

Figure 2:
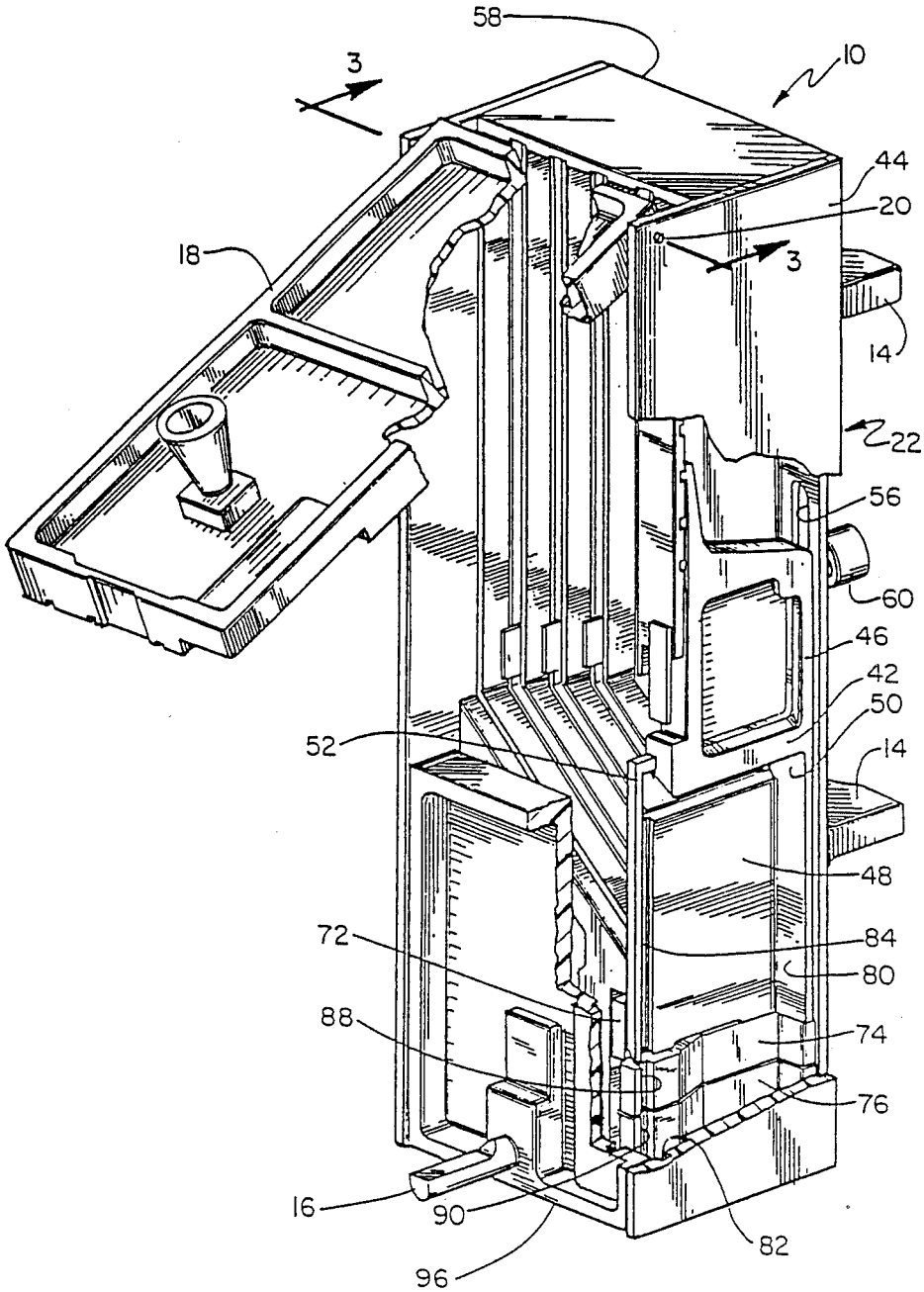
FIG. 2 is a perspective view of the orienter portion with the door in an opened position and with a portion of one side wall cut away and with the gate opening aligned with the second space.

Referring now to FIG. 2, the orienter 10 is depicted in the form of a box or rectangular parallelepiped. Projecting outward of one wall of the orienter 10 are two feet 14. Posts 16 project outward of two opposite faces of the orienter for holding the orienter 10 adjacent the loader 12 as described below. A door 18 is provided on one face of the orienter 10 attached by hinges 20 to provide access to the interior of the orienter 10. The upper portion 22 of the orienter 10 contains a plurality of rails with upper portions 24A, 26A, 28A, 30A, 32A which are parallel to a wall of the orienter 10 and lower portions 24B, 26B, 28B, 30B, 32B which are angled with respect to the upper portion. The rails are substantially parallel and spaced apart. The distance which the rails are spaced apart relates to the dimensions of the cartridges with which the orienter 10 is intended to be used. The spacing between the rails is greater than the diameter of the cartridge body portion but less than the diameter of the cartridge rim. In this way, the rails define a number of slot-shaped spaces 34, 36, 38, 40.

Figure 3:
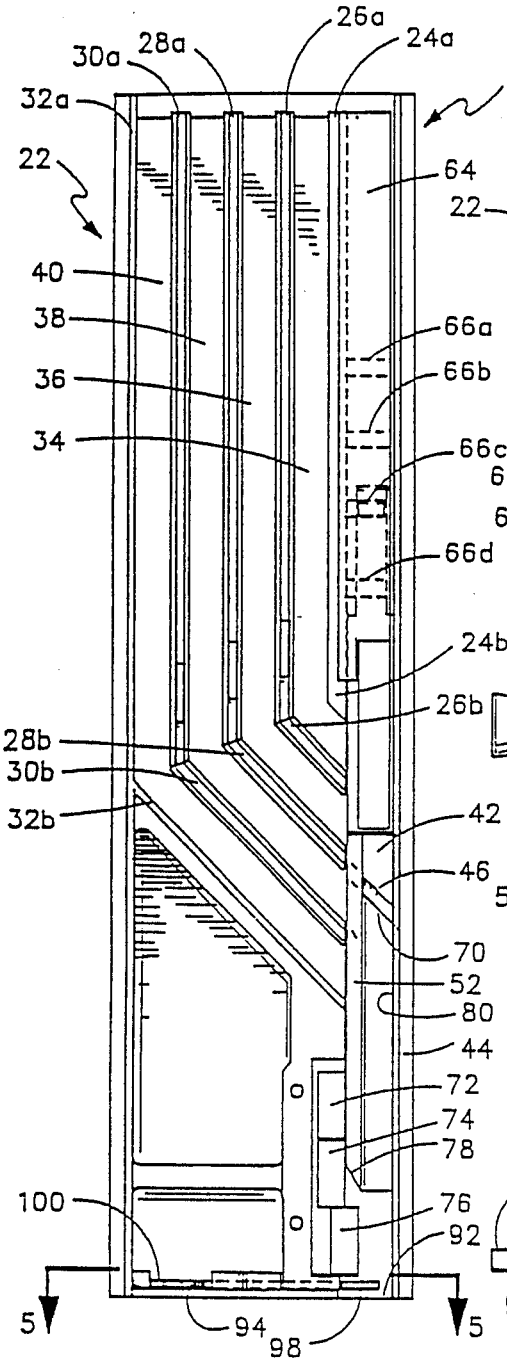
FIG. 3 is a cross-sectional view taken along lines 3—3 of FIG. 2 but with the gate opening aligned with the third space.
Figure 4:
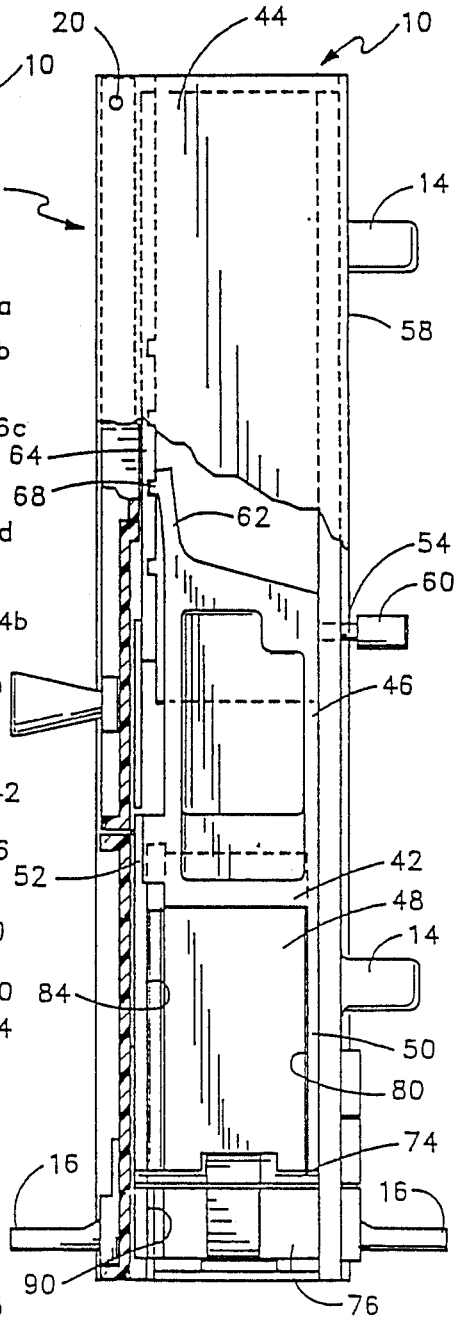
FIG. 4 is a side elevational view of the orienter portion with a part of the side wall broken away.

A gate 42 is slidably mounted adjacent to a first wall 44 of the orienter 10. The gate 42 includes an upper portion 46 and a lower portion 48 attached so as to slide together using an extension 50 integrally formed with an edge of the lower portion 48 and an arm 52 extending from the upper portion 46 to the lower portion 48. As seen in FIG. 4, a rod 54 extends outward from the gate 42 through a slot 56 formed in a second side wall 58. A handle 60 is attached to the rod 54 for controlling movement of the gate 42. An arm 62 extends upward from the gate 42 and resiliently presses against a control surface 64. The arm 62 and control surface 64 interact to releasably hold the gate 42 in one of a number of preferred positions. As depicted in FIG. 3, the interaction of the arm 62 and control surface 64 is accomplished by providing the control surface 64 with a number of depressions or notches 66A, 66B, 66C, 66D and providing a protrusion such as an integrally molded detent 68 attached to the arm 62. When the gate 42 is positioned such that the protrusion 68 aligns with one of the notches 66, the gate 42 is releasably held in such position.

The upper portion 46 is spaced from the lower portion 48 to define a space 70 between the upper portion 46 and the lower portion 48. The size of the gate space 70 corresponds to the distance between the rails 24, 26, 28, 30, 32. The notches 66 are positioned such that when the detent 68 is aligned with one of the notches 66A-D, the space 70 is aligned with the lowermost portion of the slots 34, 36, 38, 40 respectively. Spacers 72, 74, 76 are resiliently mounted opposite to and spaced from the lower portion of the first wall 44. The lower edge 78 of the lower portion of the gate 42 is angled so that as the gate 42 is moved downward, the lower edge 78 of the gate 42 forces the spacers 72, 74, 76, in turn, in a direction away from the first wall 44. The spacers 72, 74, 76 are dimensioned so that when the gate space 70 is aligned with any of the slots 34, 36, 38, except the lowermost slot 40, a surface of one or more of the spacers 72, 74, 76 will be aligned with the surface of the lower portion 48. In this way, the spacers 72, 74, 76 cooperate with the gate 48 and the first wall 44 to define a chute 80 having a variable dimension, depending upon the position of the gate 42. The chute 80 is provided with rim guides in the form of slots. One slot 82 is formed in the first wall 44. Another slot 84 is formed in the lower gate 48 and is positioned to align with slots 86, 88, 90 formed in the spacers 72, 74, 76 respectively.

The dimensions of the slots 34, 36, 38, 40, gate space 70, notches 66, chute 80 and gate 42 are coordinated to provide for control of movement of cartridges from the slots 34, 36, 38, 40 into the chute 80. Specifically, when the detent 68 is aligned with a slot 66, the gate space 70 provides communication between one of the slots 34, 36, 38, 40 and the chute 80. At the same time, the upper portion of the gate 46 and the lower gate portion 48 prevent communication between the chute 80 and any of the slots 34, 36, 38, 40 other than that slot which is in communication with the chute 80.

Figure 5:
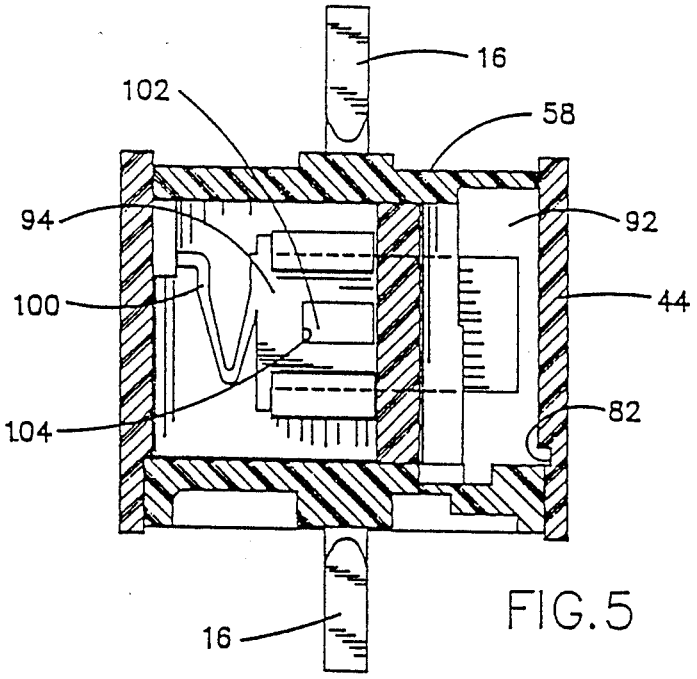
FIG. 5 is a bottom plan view of the orienter portion showing portions of the latch in phantom lines with the gate opening aligned with the fourth space.

An opening 92 is provided in the lower portion of the chute 80 to allow removal of cartridges from the orienter 10. As best seen in FIG. 5, a latch 94 is provided on the bottom surface 96 of the orienter 10. Extending from the latch 94 is a tongue 98 extending at least partially across the opening 92 to close the opening 92 so as to prevent removal of cartridges through the opening 92 until the tongue 98 is moved. The latch 94 is slidably mounted against the bottom surface 96 and provided with a spring 100 for urging the tongue 98 towards the first wall 44 so as to cover the opening 92. The spring 100 can be any type of spring but is preferably an integrally molded leaf spring. The latch 94 is provided with an opening 102, an edge 104 of which interacts with a cam on the loader 12 to move the latch 94 in a manner described below.

Figure 10:
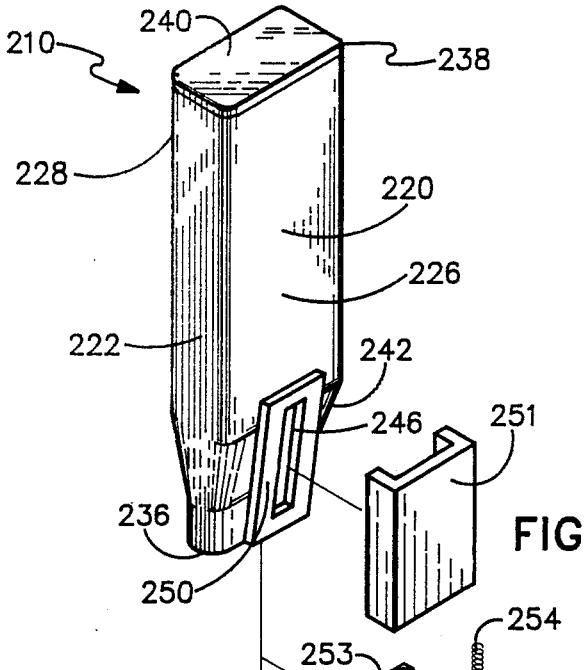
FIG. 10 is an exploded view of the collector also showing a cartridge.

According to a second embodiment, a collector 210 is provided. As best seen in FIG. 10, the collector 210 comprises a holding portion 220 having first and second end walls 222, 224 and first and second side walls 226, 228. The walls 222, 224, 226, 228 define a holding chamber 230 for holding the cartridges. The chamber 230 has an open end 236 and a top end 238 which is preferably covered by an end cap 240. The lower portion 242 of the holding chamber 230 preferably tapers to provide a single file feed of cartridges as described below.

The lower portion 242 is provided with a window 246 for use in connection with a latching mechanism which includes a latch body 248, a spring 254 and a latch opening slide 251. As depicted in FIGS. 9–13, 16 and 19, the latching mechanism is positioned adjacent to the first side wall 226. The latching mechanism can be positioned elsewhere. In particular, when it is desired to use the collector 210 for more than one type of cartridge, such as .45 caliber as well as 9 millimeter cartridges, the latch mechanism 248, 251, 254 is preferably positioned adjacent to the second side wall 228. The location adjacent to the second side wall 228 is otherwise the same as depicted in FIGS. 9–13, 16 and 19, i.e., the latch mechanism 248, 251, 254 will have substantially the same relative height and lateral location as depicted in FIGS. 9–13, 16 and 19. The reason that positioning adjacent to the second side wall 228 is preferred when the collector 210 is used in connection with more than one type of cartridge is that both the 9 millimeter and .45 caliber cartridges can be accommodated by changing only the configuration of the latch body 248. When the latch mechanism 248, 251, 254 is positioned adjacent to the first side wall 226, as depicted in FIGS. 9–13, 16 and 19, accommodating both 9 millimeter and .45 caliber cartridges would require modification of the internal configuration of the loader 212.

Figure 11:
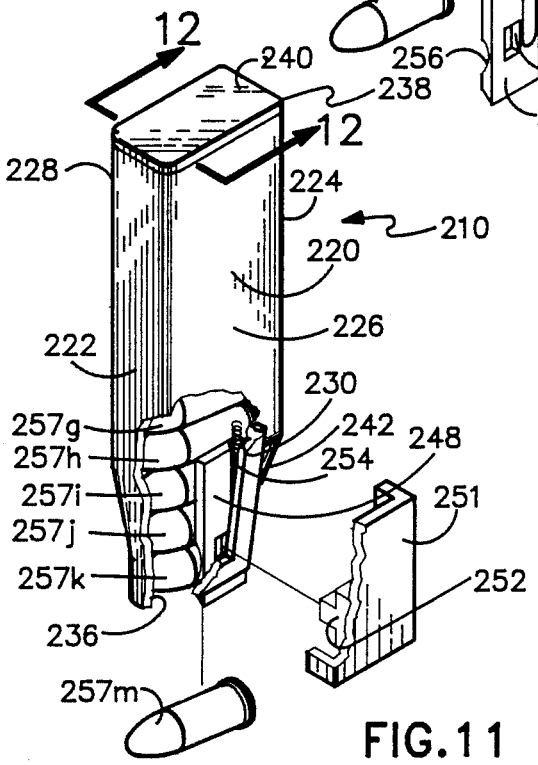
FIG. 11 is a partially exploded view of the collector with parts of the collector cut away and with cartridges, some of which are in the collector.
Figure 12:
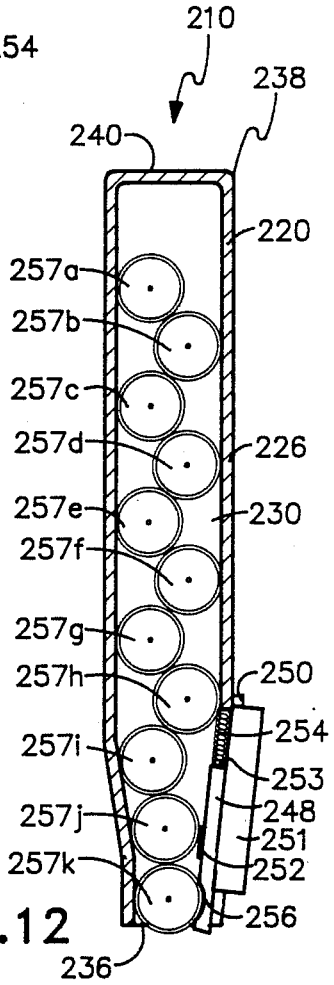
FIG. 12 is a cross-sectional unexploded view of the collector, taken along lines 12—12 of FIG. 11.
Figure 13:
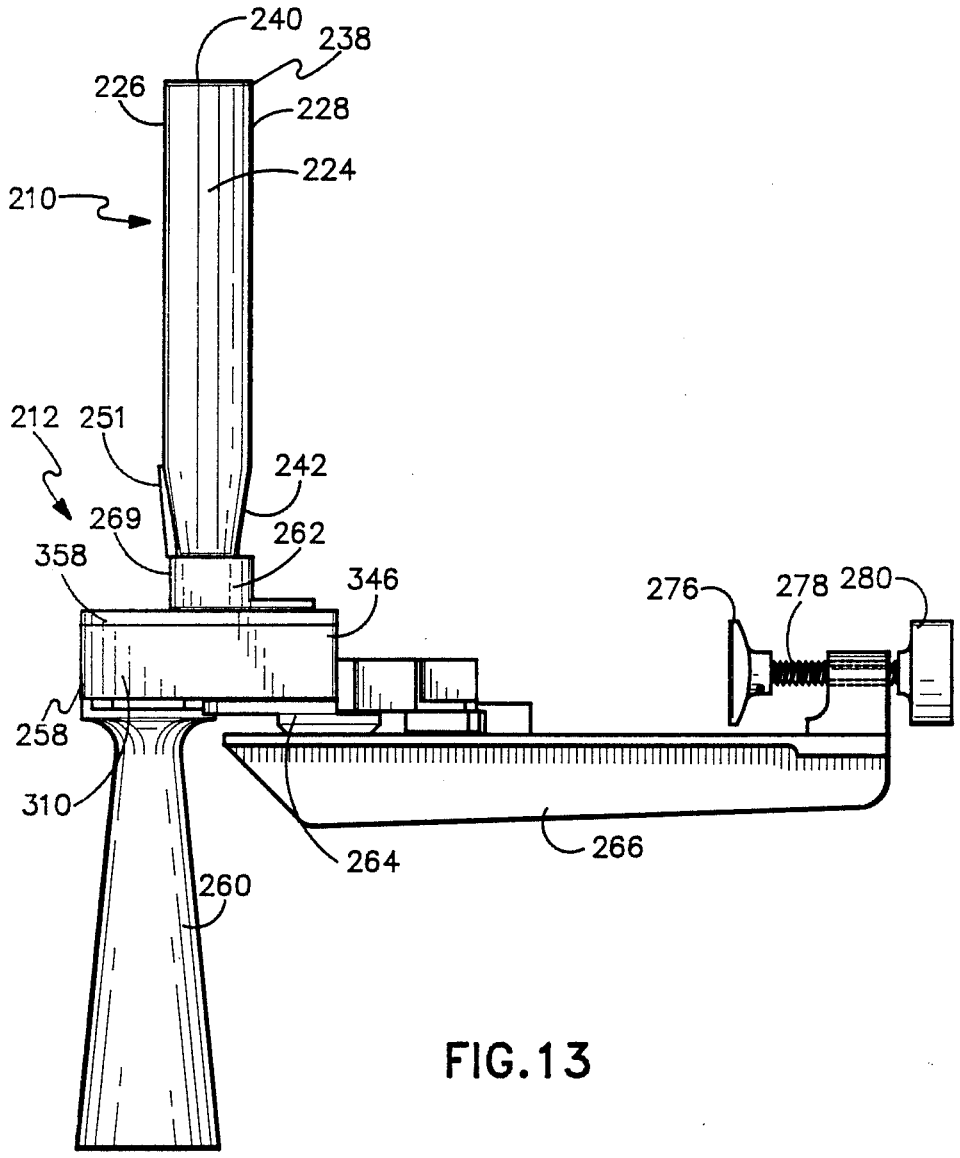
FIG. 13 is a side elevational view of the embodiment depicted in FIG. 9, without the magazine.

As seen in FIGS. 10–12, the latch body 248 is mounted in the chamber 230 adjacent to the window 246. The latch body 248 is mounted in a recess 250 formed in the lower portion 242 so that it is slidable from a lowermost position, as depicted in FIG. 12, to an upper position in which the top edge 253 of the latch body 248 is moved in a direction towards the top of the recess 250. The latch body 248 is urged towards the lowermost position by a biasing device such as a spring 254. The exterior surface of the recess 250 has a shape which corresponds to the interior shape of a latch opening slide 251. The latch opening slide 251 includes a tooth 252 which, when the slide 251 is positioned over the exterior surface of the recess 250, extends through the window 246. The latch body 248 includes a window 255 which is at least partly aligned with the collector body window 246. The latch body 248 also includes a cut-out area 256 of a shape to generally correspond to the exterior shape of a portion of one of the cartridges 257*a–n*. In particular, the cut-out 256 of the latch body 248 in its lowermost position, as depicted in FIG. 12, contacts and cradles the lowermost cartridge 257*k* to hold the lowermost cartridge 257*k* in the collector 210 against the force of gravity. The tooth 252 of the latch opening slide 251 extends through the window 255 of the latch body 248. In this way, when the slide 251 moves upward, the tooth 252 engages the latch body 248 and causes the latch body 248 to move upward, against the urging of the spring 254. Alternatively, the tooth 252 can be attached to or integral with the latch body 248 so that, when the collector 210 is assembled, the tooth 252 extends through the window 246 and engages with the slide 251, such as by being seated and/or glued or otherwise attached in a window or recess (not shown) formed therein. In either configuration, upward or downward movement of the slide 251 causes the latch body 248 to move upward or downward. Because the latch 248, being parallel to the inclined wall of the lower portion 242 is itself inclined, as the latch 248 moves upward, the distance from the latch 248 to the opposite second side wall 228 is larger and, with sufficient upward movement, becomes sufficiently large that the distance to the second side wall 228 is greater than the diameter of a cartridge 257, thus permitting passage of a cartridge 257 through the opening 236.

Figure 8:
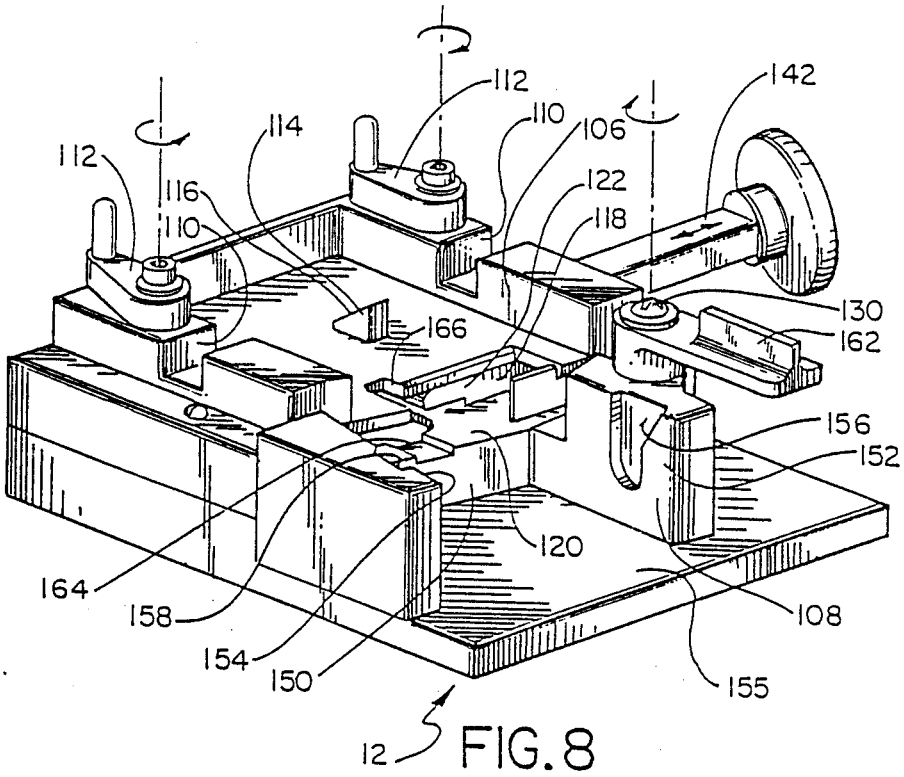
FIG. 8 is a perspective view of the loader base portion.

Referring now to FIG. 8, the loader 12 is provided with a orienter receiving area 106 and a magazine receiving area 108. The orienter receiving area 106 has a configuration substantially corresponding to the size and shape of the bottom surface 96 of the orienter 10. Slots 110 are provided for receiving the posts 16. Latches 112 are rotatably mounted adjacent to the slots 110 to hold the posts 16 in the slots 110 in the manner depicted in FIG. 1. A cam 114 is positioned in the orienter receiving area 106 and provided with a slanting camming surface 116. The cam 114 is positioned such that when the orienter 10 is placed into the orienter receiving area 106 and the posts 16 are registered in the slots 110, the upper surface 116 of the cam 114 engages with the edge 104 of the opening 102 in the latch 94 to move the latch 94 against the urging of the spring 100. This movement of the latch 94 results in the tongue 98 being withdrawn from the opening 92. When the orienter 10 is in the orienter receiving area 106 in the position described, the opening 92 of the chute 80 will lie directly above the cartridge receiving area 118.

Figure 6:
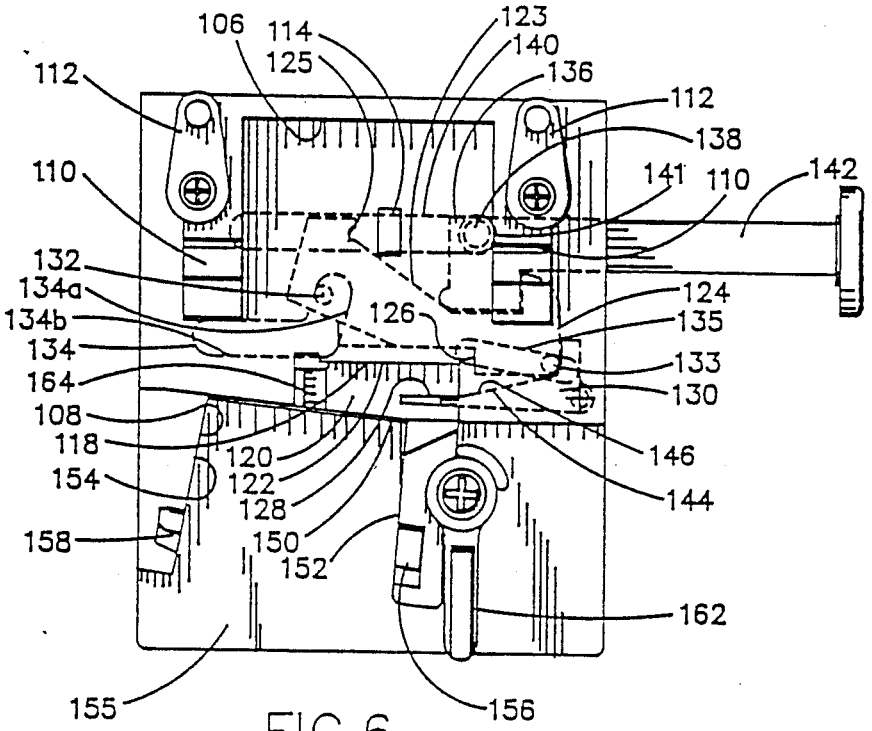
FIG. 6 is a top plan view of the loader base portion showing the cam and cam followers in phantom lines.
Figure 7:
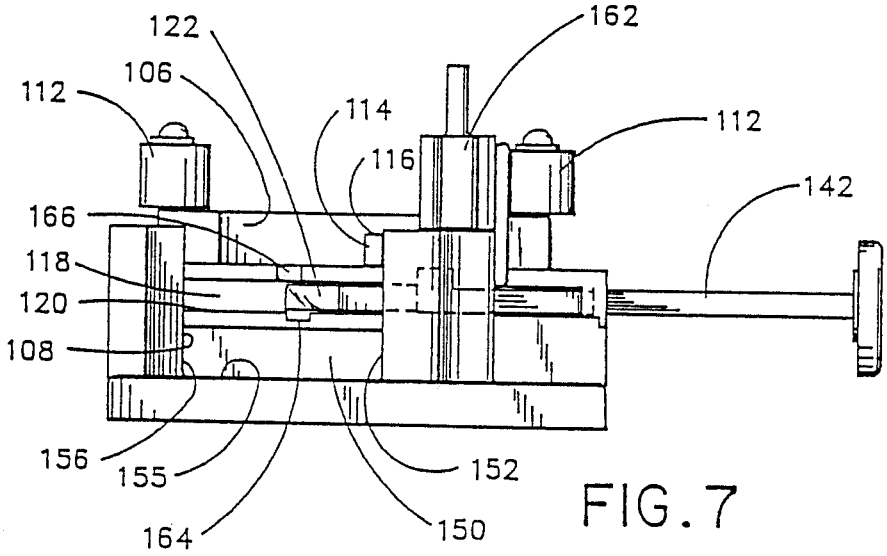
FIG. 7 is a front elevational view of the loader base portion showing parts of the cartridge receiver in phantom lines.

With reference also to FIGS. 6 and 7, the cartridge receiving area 118 is defined by a lower surface 120, first and second cartridge contact surfaces 122, 126 of a first cam follower 124 and a first cartridge contact surface 128 of a second cam follower 130.

The first cam follower 124 and the second cam follower 130 are mounted underneath the orienter receiving area 106. The first cam follower 124 is provided with first and second protrusions 132, 133 extending downward through first and second slots 134, 135. The movement of the first cam follower 124 is thus in part guided by the protrusions 132, 133 bearing against edges of the slots 134, 135. The moving cam 136 is also provided with a protrusion 138 constrained to move within a slot 140. The moving cam 136 is attached to a rod or plunger 142 for moving the moving cam 136.

The second cam follower 130 has an angled surface 144 adjacent to a surface 146 of the first cam follower 124. The surface 146 of the first cam follower 124 itself acts as a cam for the second cam follower 130.

A spring 141 is provided to urge the moving cam 136 towards the position depicted in FIG. 6 in which both cam followers 124, 130 are positioned farthest from the magazine receiving area 108.

The magazine receiving area 108 is defined by a back wall 150, side walls 152, 154, and a bottom surface 155. The side walls 152, 154 contain grooves 156, 158 for receiving protrusions (not shown) on a magazine 160 to hold the magazine 160 properly registered in the magazine receiving area 108. A latch 162 is rotatably mounted adjacent to the magazine receiving area 108 and positioned such that the latch 162 can be rotated to hold the magazine 160 in the magazine receiving area 108 in the desired position. A groove 164 is formed in the bottom surface 120 of the cartridge receiving area 118 leading from the cartridge receiving area 118 to the magazine receiving area 108. A slot 166 is formed in the orienter receiving area 106 leading to the cartridge receiving area 118. The groove 164 and slot 166 cooperate to accommodate the rim of a cartridge and to guide movement of the cartridge during the loading.

According to a second embodiment as depicted in FIGS. 9 and 13–20, a loader 212 includes a body housing 258, a handle 260, a collector receiving area 262, a magazine receiving area 264 and a magazine clamp 266. The magazine receiving area 264 is shaped to receive the portion of the magazine 268, which is adjacent to the open end 269 of the magazine 268, through which cartridges 257 are loaded and moved towards the second or opposite end 271 of the magazine 268. The magazine receiving area 264 can be detachably connected to the body housing 258 of the loader, such as by connection to a button hole holder 270.

Figure 15:
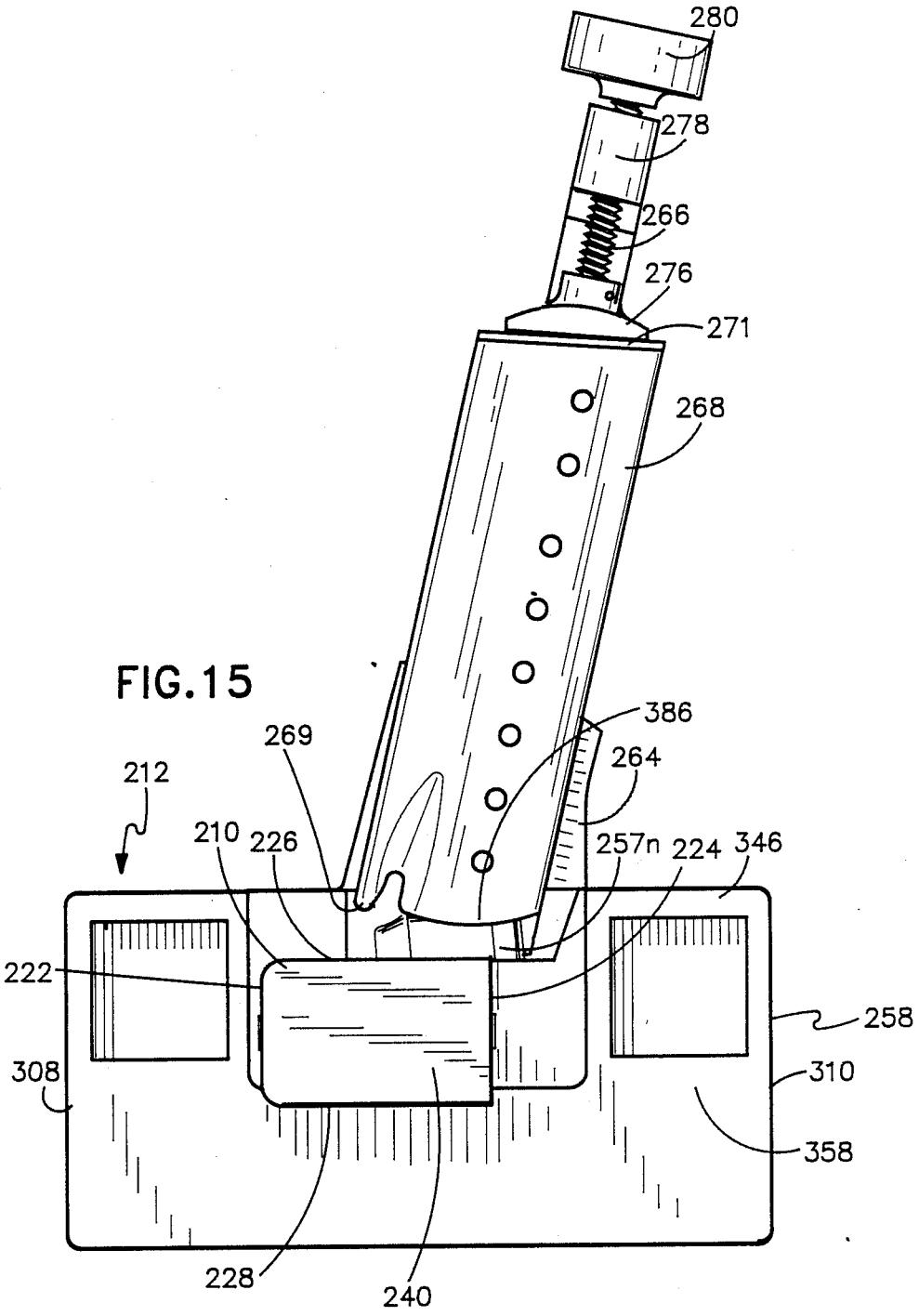
FIG. 15 is a top plan view of the embodiment depicted in FIG. 9.

The magazine receiving area 264 includes a first guide ramp 273 positioned near the area where the open end 269 of the magazine is received, to assist in proper loading despite slightly different configurations of different magazines, as more fully described below. The magazine clamp 266 is connected to the loader body housing 258 by a button 272, engagable with the button hole holder 270 and a hook 274. A pressure pad 276 is attached by a screw device 278 which is adjustable by a clamp handle 280 so that the pressure pad 276 can be positioned adjacent to the magazine 268 and clamp the magazine 268 in the magazine receiving area 264, as best seen in FIG. 15. The pressure pad 276 is preferably pivotally connected to the screw device 278 so as to be positionable flush against the magazine 268.

Figure 16A:
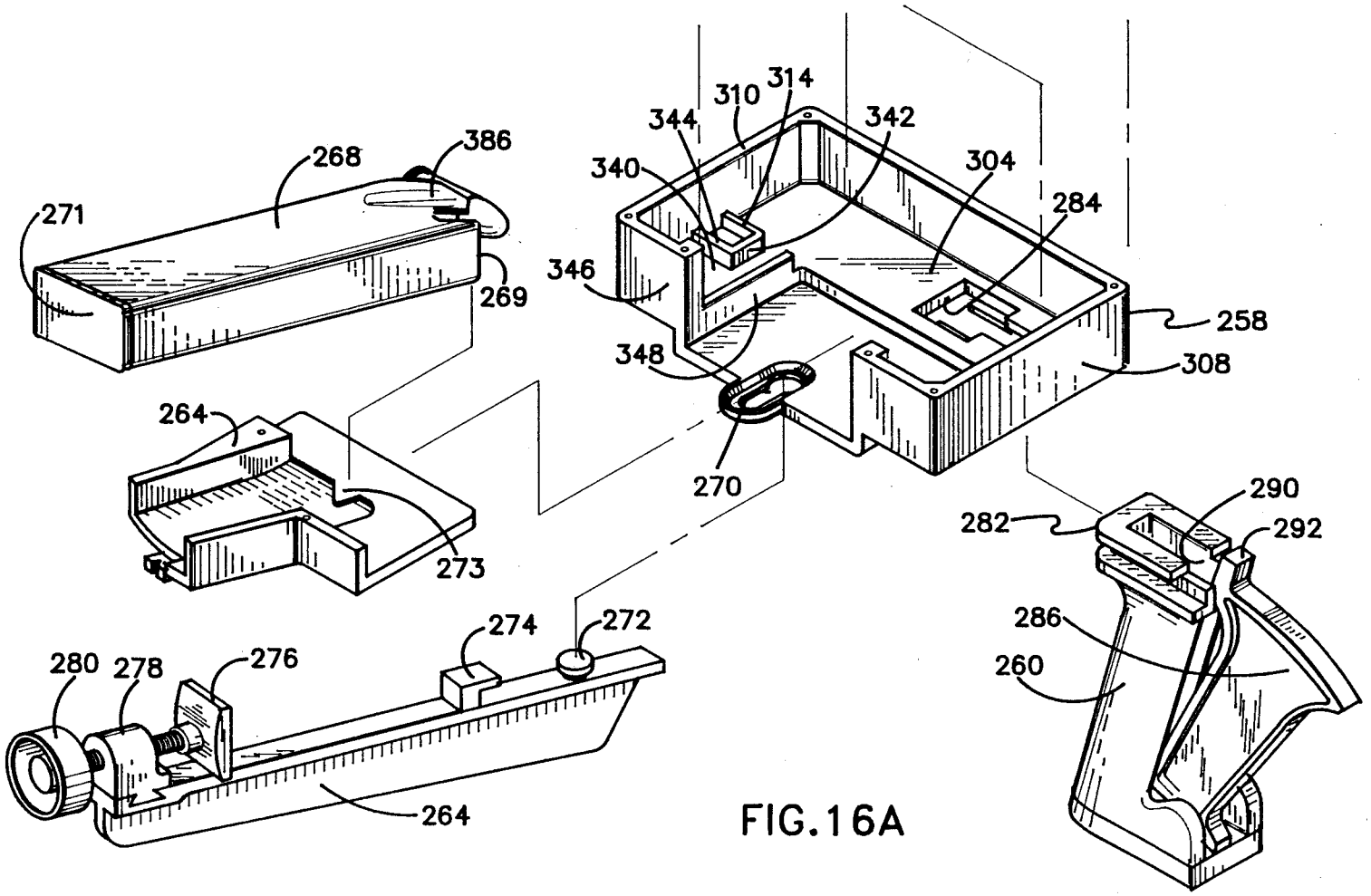
FIG. 16 (presented on two sheets as FIGS. 16A and 16B) is an exploded view of the apparatus depicted in FIG. 9, also showing cartridges, but without the magazine.
Figure 16B:
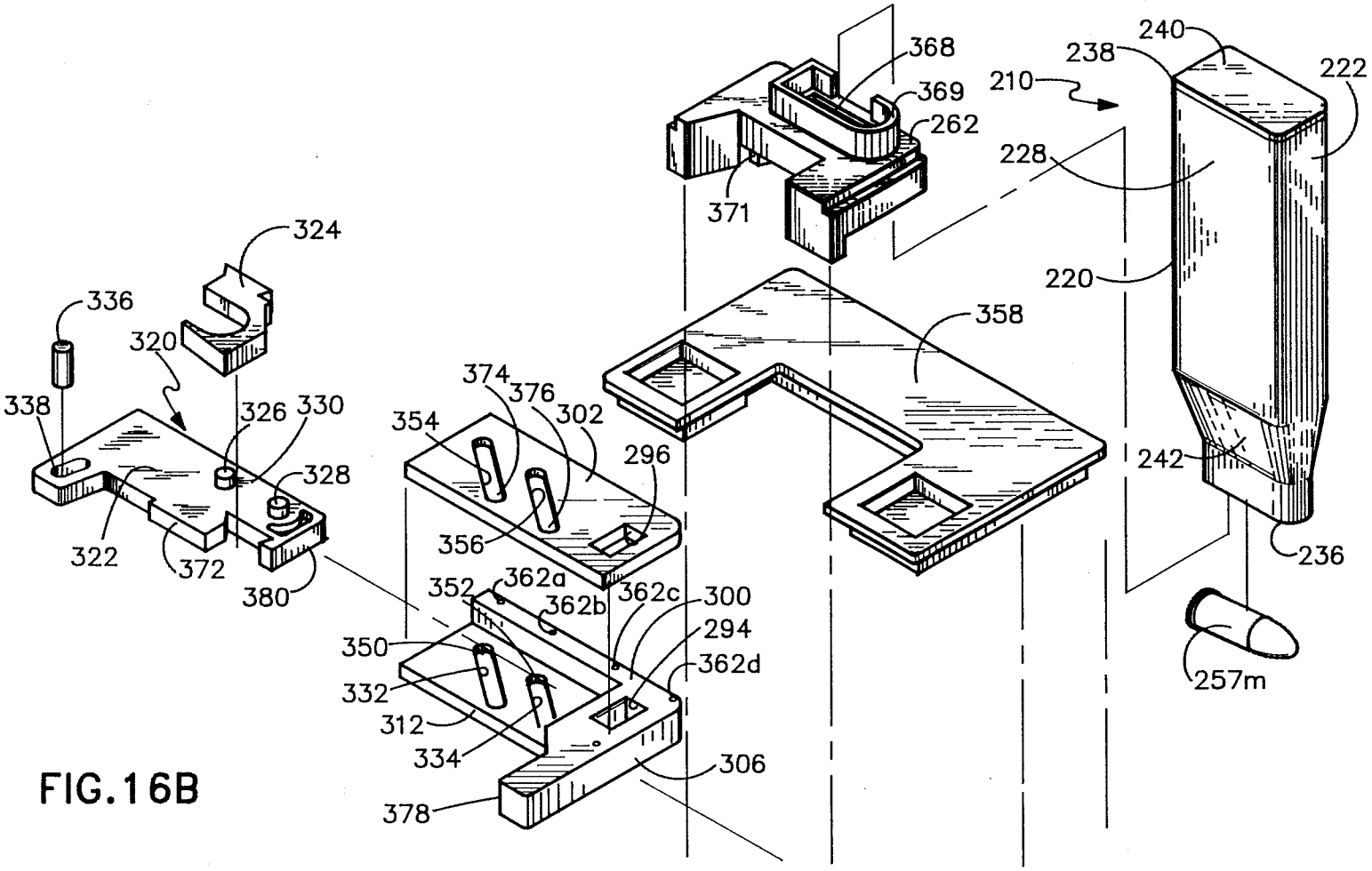

The handle 260 is attached to the body housing 258, for example, by the tongue and groove-shaped head 282 which fits into the complimentary-shaped slot 284 of the body housing 258. The handle 260 is of a size and shape to be held by a single hand of the user. A lever 286 is pivotally attached to the handle 260 by, e.g., a pin on the interior region of the handle and integral therewith (not shown). The lever 286 can be pivoted about the pin so as to fit within a recess 290 of the handle 260. The lever 286 is biased towards the position outside of the recess 290, as depicted in FIG. 16, by a conventional biasing device such as a spring located in the handle (not shown). Preferably the lever 286, in its biased position, can be grasped by the same hand which holds the handle 260. A tooth 292 projects upwardly from the lever 286 to engage with holes 294, 296 of sliding bodies 300, 302, which are disposed within the body housing 258, for a purpose to be described below.

The first sliding body 300 is positioned in the loader body housing 258 adjacent to the bottom surface 304 thereof. Because the tooth 292 of the lever 286 resides within the hole 294 of the lower sliding body 300, the biasing of the lever 286 to the position depicted in FIG. 16 results in the biasing of the sliding body 300 to the position depicted in FIG. 14 in which a first edge 306 of the lower sliding body 300 is adjacent to a first side wall 308 of the body housing 258. Movement of the tooth 292 as the lever 286 is moved into the recess 290 results in movement of the first sliding body 300 towards the second side wall 310 of the body housing 258. This direction of sliding is constrained to be substantially linear by the fact that the front edge 312 of the first sliding body 300 bears against a first interior wall 314 of the body housing 258.

A cartridge engagement piece 320 includes a body portion 322 and a nose hook 324. The nose hook 324 is connected to the body portion 322 by any of a number of connecting devices such as the dovetail configuration depicted. The connected parts can be held in place by any conventional method such as welding or gluing or can be held in place by the dovetail arrangement depicted. By providing the nose hook 324 in a separate piece, it is possible to provide the loader 212 with different configurations of nose hooks 324 to accommodate differing nose shapes of different styles of cartridges. The cartridge engagement piece 320 includes first and second posts 326, 328 which project upward from the upper surface 330 of the cartridge engagement piece 320. The posts 326, 328 extend through the cartridge engagement piece 320 and also project downward from the lower surface (not shown) of the cartridge engagement piece 320. The cartridge engagement piece 320 is positioned above the first sliding body 300 so that the lower projecting portions of the first and second posts 326, 328 fit snugly but slidably in first and second slots 332, 334, respectively, of the lower sliding body 300. A pin 336 is inserted through hole 338 of the cartridge engagement piece to project downwardly and upwardly therefrom. The pin 336 is constrained to remain in the L-shaped channel 340 defined by second and third interior walls 342, 344, and interior surfaces of the housing body front wall 346 and indentation wall 348. The result of this configuration is that the cartridge engagement piece 320 is constrained to lie in the position depicted in FIG. 14, with the first and second posts 326, 328 in the rearward most positions 350, 352 of the first and second slots 332, 334 when the first sliding body 300 is in the position depicted in FIG. 14, as described above.

The second sliding body 302 is positioned above both the first sliding body 300 and the cartridge engagement piece 320. The second sliding body 302 contains first and second slots 354, 356 which are aligned with the first and second slots 332, 334 of the first sliding body 300 so that the cartridge engagement piece posts 326, 328 project through the first and second slots 354, 356 of the upper sliding body 302. Preferably the upper sliding body 302 is constrained to move along with the lower sliding body 300 by projection of the lever tooth 292 through the hole 296 of the upper sliding body 302 and/or connection means such as engagement of pins (not shown) on the lower portion of the upper sliding body 302 with holes **362*a–d* in the lower sliding body 300**.

Figure 14:
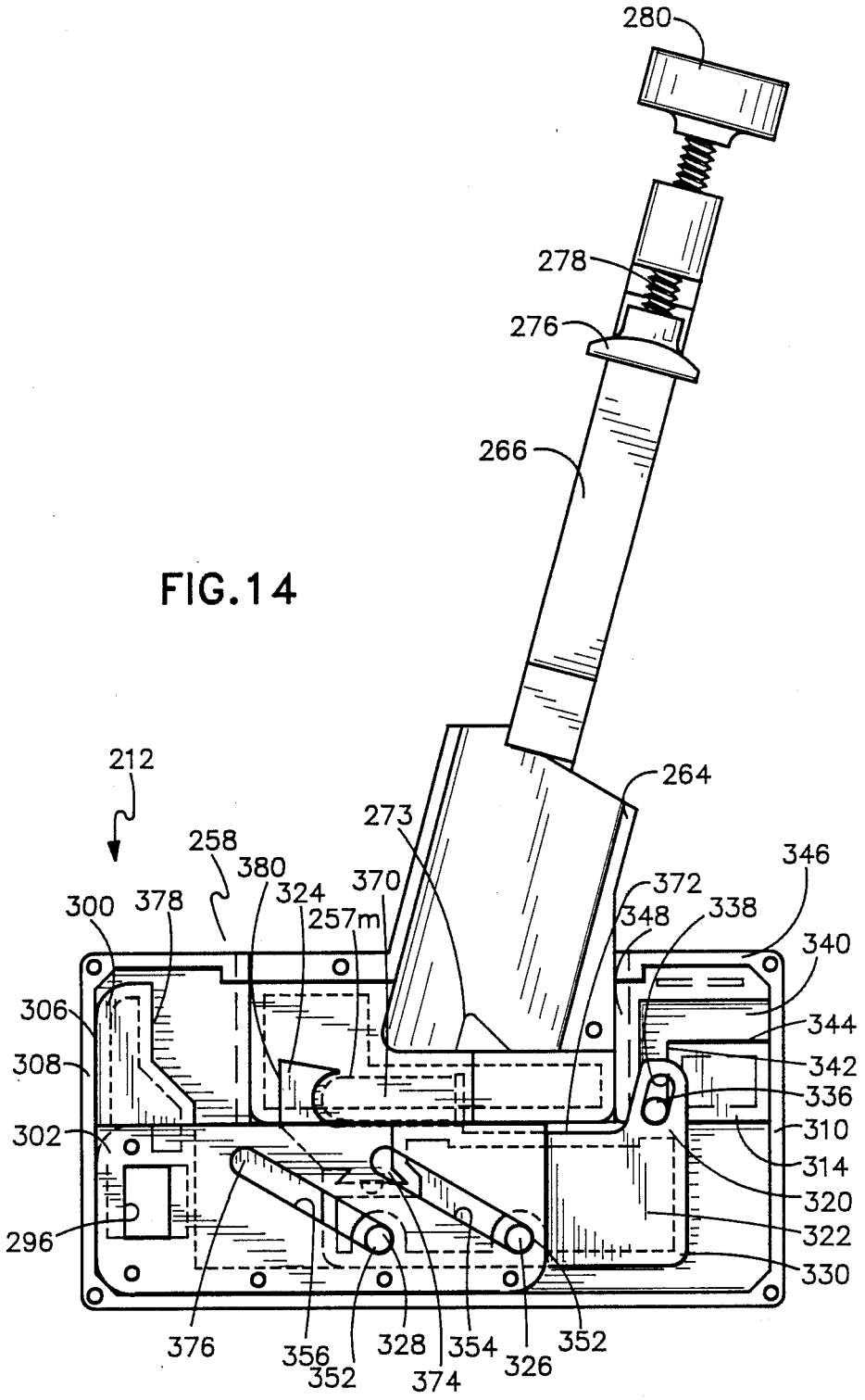
FIG. 14 is a top plan view of FIG. 13, but with the housing body cap removed.

A housing body cap 358 is attached to the housing body 258 by conventional means such as welding, gluing, screwing, and the like. The collector receiving body 262 is positioned relative to the lower body housing 258 and/or cap 358 such that a cartridge passageway 368 thereof is vertically aligned with a cartridge receiving area 370 of the loader, as depicted in FIG. 14. In the embodiment depicted in FIG. 14, the cartridge holding region 370 is at least partly defined by the forward wall 372 of the cartridge engagement piece 320 and the nose hook 324, and is generally the region occupied by the first cartridge **257*m* depicted in FIG. 14. By making the collector receiving body 262 detachable, receiving bodies 262 having differently configured passageways 368** can be substituted into the loader to accommodate different configurations of cartridges.

The collector receiving area 262 includes a collar 369 around the passageway 368. The position of the latch opening slide 251 is such that when the collector 210 is inserted into the collector receiving area 262, the collar 369 contacts the latch opening slide 251 causing it to move upward and, in turn, causing the latch body 248 to move upward and permit passage of cartridges 257 through the opening 236, as described above.

Figure 20:
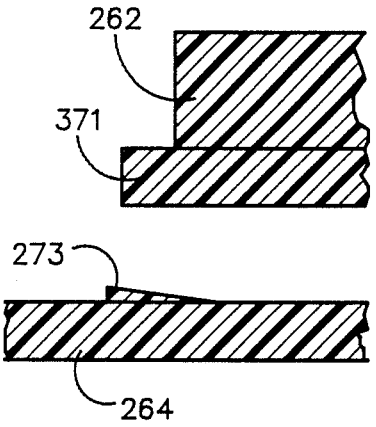
FIG. 20 is a partial cross-sectional view taken along line 20—20 of FIG. 17.
Figure 17:
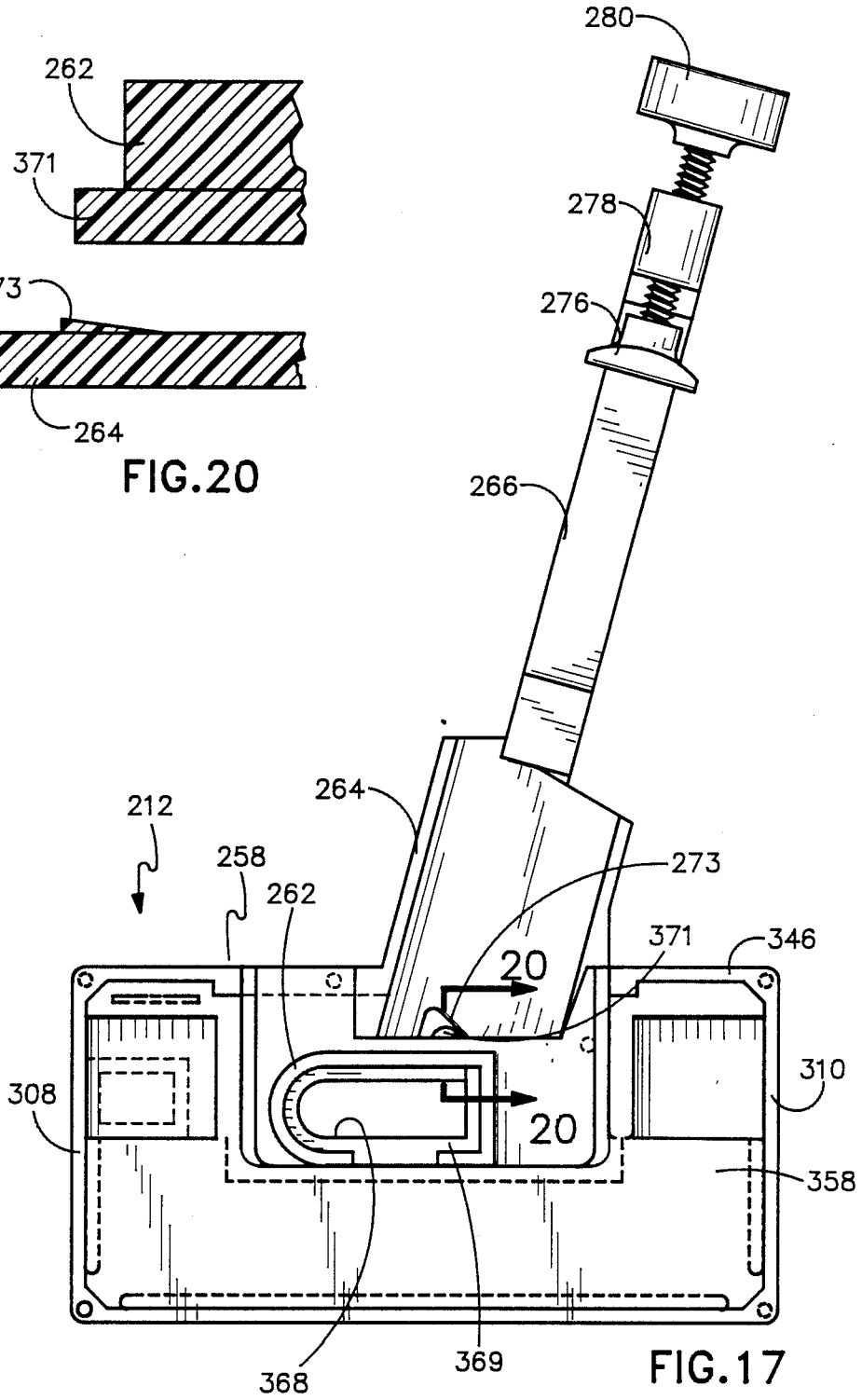
FIG. 17 is a top plan view of the loader without the collector or magazine.
Figure 18:
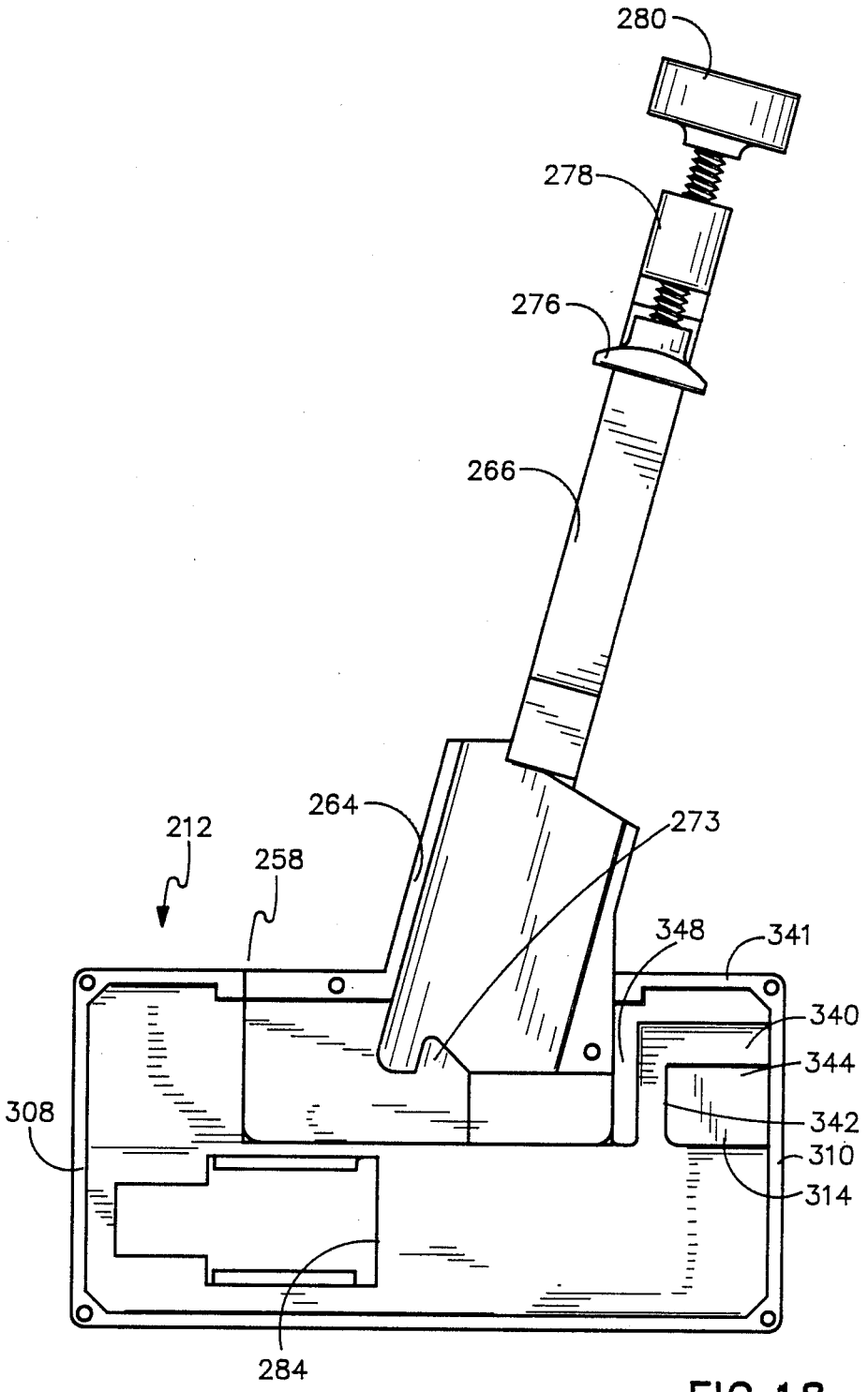
FIG. 18 is a top plan view of the loader housing, magazine receiving area and clamp, without the housing cap or interior bodies.
Figure 19:
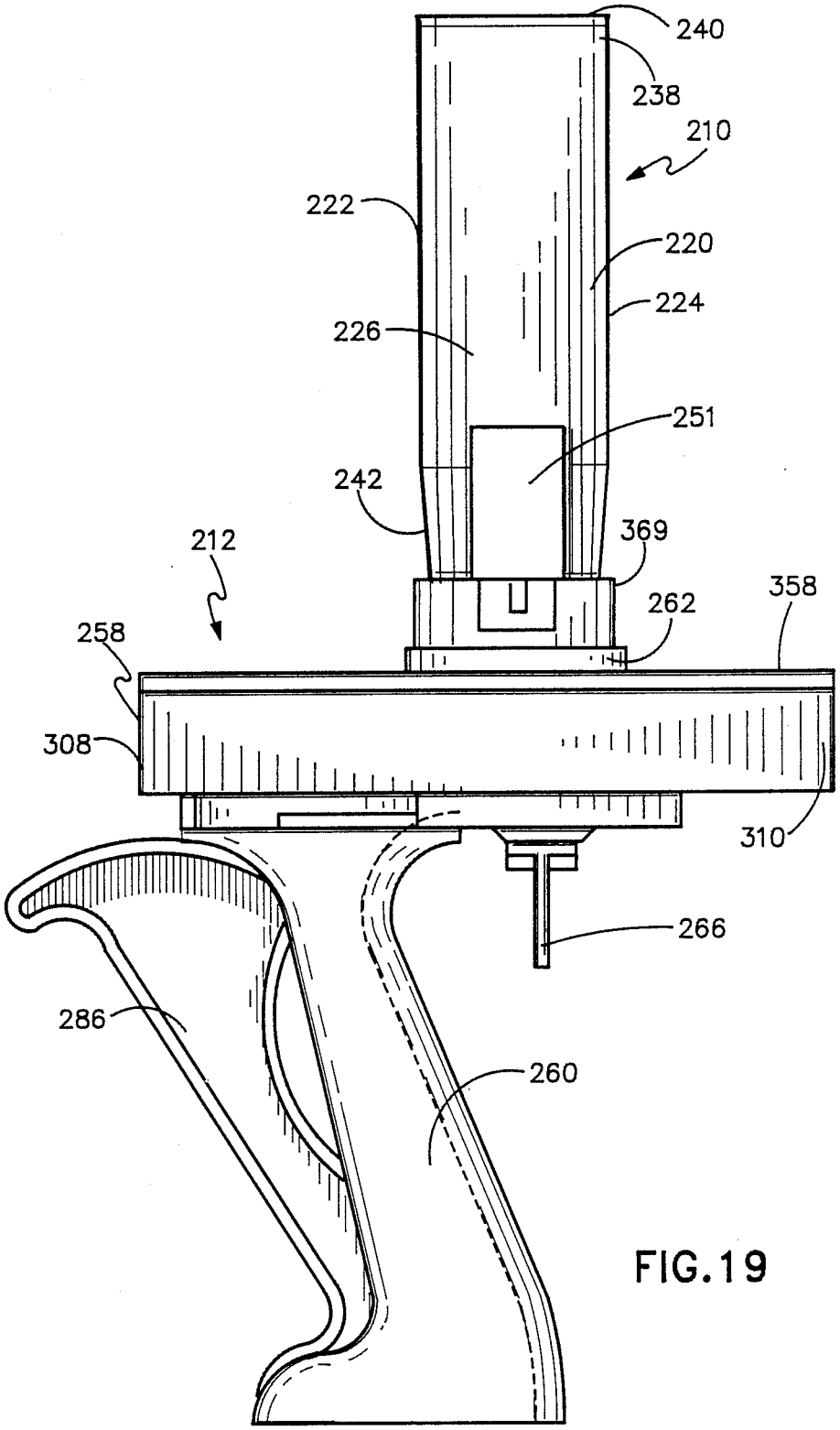
FIG. 19 is a rear elevational view of the apparatus of FIG. 9.

As best seen in FIG. 20, the underside of the collector receiving body 262 (i.e. the side which faces into the interior of the housing body 258) includes a second guide ramp 371 descending from the underside of the receiving body 262 and integral therewith for maintaining proper positioning of a cartridge as it is moved, as more fully described below.

Operation of the preferred embodiments of this invention will now be described. The orienter 10 is detached from the loader 12 and placed in a horizontal position, i.e. supported by the feet 14 with the door 18 facing upwards. The door 18 is opened and a plurality of unoriented rim-fire cartridges are placed within the orienter 10 adjacent to the rails 24, 26, 28, 30, 32. The orienter 10 is agitated by shaking or vibrating while maintaining the orienter 10 in a substantially, though not necessarily strictly, horizontal position. Because the nose-portions of rim-fire cartridges are substantially heavier than the rim-portion of rim-fire cartridges, as the orienter 10 is agitated, the nose portions of the cartridges will fall or swing downward between the rails 24, 26, 28, 30, 32. Since the spaces 34, 36, 38, 40 are larger than the body diameters but less than the rim diameters, the cartridges will be hung by their rim-portions from the rails with the nose portions pointing downward. By this means, the unoriented cartridges are placed in an oriented position, i.e. with the longitudinal axes of the cartridges being substantially parallel and the nose-portion of the cartridges pointing downward.

The door 18 of the orienter 10 is then closed and the orienter 10 is up-ended to a position in which the bottom surface 96 of the orienter 10 is facing downward and the first and second side walls 44, 58 are in a substantially vertical position. In this orientation, the rails 24, 26, 28, 30, 32 will be in a substantially vertical position. The force of gravity will cause the cartridges to slide through the spaces 34, 36, 38, 40 in a direction substantially perpendicular to the longitudinal axes of the cartridges so that the cartridges will lie adjacent to each other in the lower portions of the spaces 34, 36, 38, 40. The cartridges will thus be positioned in a plurality of stacks or columns lying in the spaces 34, 36, 38, 40. By a stack or column of cartridges is meant that the longitudinal axis of any particular cartridge in a column or stack is substantially, but not necessarily precisely, parallel to the longitudinal axis of a neighboring cartridge in the same column or stack. Because the rim diameters are larger than the body diameters, the cartridges in a column will not be as nearly parallel as was the case when the orienter 10 was in a horizontal position. Because the upper and lower portions of the rails 24, 26, 28, 30, 32 meet at an angle, the longitudinal axes of cartridges in a particular column will not be coplanar.

The handle 60 of the gate 42 is moved to slide the gate to a position in which the detent 68 is aligned with one of the notches 66A, 66B, 66C, 66D. For purposes of example, the operation of the invention will be described with reference to a configuration when the detent 68 is aligned with the third notch 66C, as depicted in FIG. 3. In this configuration, the gate space 70 is aligned with the lowermost portion of the third space 38. Under the influence of gravity, the column of cartridges in space 38 will move through the gate space 70 and into the chute 80. Movement of the cartridges through the chute 80 will be partially controlled by the cartridge rims moving through the grooves 82, 84, 90. The lowermost of the cartridges in the chute 80 will abut against the tongue 98 of the latch 94 to prevent any cartridges exiting from the orienter 10.

The orienter 10 is engaged with the loader 12 by positioning into the orienter receiving area 106 with the posts 16 residing in the slots 110 and latched therein by latches 112, as depicted in FIG. 1. In this position, the upper surface 116 of the fixed cam 114 will move the latch 94 against the urging of the spring 100 to withdraw the tongue 98 from the chute opening 92. The lowermost cartridge in the chute 80 will then fall by the force of gravity into the cartridge receiving area 118. An empty or partially empty magazine 160 is placed into the magazine receiving area 108 by sliding protrusions on the magazine 160 through the grooves 156, 158, positioning one surface of the magazine 160 against the bottom surface 155 of the magazine receiving area 108 and rotating latch 162 to hold the magazine 160 in the magazine receiving area 108. In this position, the opening (not shown) of the magazine 160 is positioned adjacent to the cartridge receiving area 118.

Plunger 142 is pushed towards the orienter receiving area causing the moving cam 136 to move in a linear fashion. As the moving cam 136 bears against the first follower surface 123 of the first cam follower 124, the first cam follower 124 moves, guided by movement of the first and second protrusions 133, 135 through the first leg 134A of the slot 134 and through slot 135, respectively. Movement of the camming surface 146 of the first cam follower causes movement of the second cam follower 130 substantially parallel to the movement of the first cam follower 124. Because the first cartridge contact surface 122 of the first cam follower 124 and the first cartridge contact surface 128 of the second cam follower 130 bear against the cartridge during this pivoting movement, the cartridge is pivoted to move the cartridge rim through the slot 166 and the groove 164. Continued movement of the plunger 142 causes continued movement of the first and second cam followers 124, 130 and consequent movement of the cartridge lying in the movable cartridge receiving area 118 until the movable cam 136 reaches the cut-out portion 125 of the first cam follower 124 and the first protrusion 132 simultaneously reaches the second leg 134B of the slot 134. At this position, the cartridge receiving area 118 has rotated to an extent that the rim portion of the cartridge lying therein has moved partially through the opening of the magazine 160 and lies in a first angular relationship with respect to the opening of the magazine 160.

As the plunger 142 is further pushed, the protrusion 132 of the first cam follower 124 moves through the second leg 134B of the slot 134 and the second protrusion 133 of the first cam follower 124 moves through the second slot 135. Because the second slot 135 is angled with respect to the orientation of the second leg 134B of the first slot 134, the cartridge receiving area will continue to move towards the opening of the magazine 160 while the angular relationship of the cartridge with respect to the opening is changed. The second cartridge contact surface 126 bears against the nose-portion of the cartridge to push the cartridge completely through the opening of the magazine 160 while the angular relationship is being changed.

The plunger 142 is now released and a spring 141 causes the plunger 142, first cam follower 124, and second cam follower 130 to return to the original position depicted in FIG. 6. In this configuration, the lowermost cartridge in the orienter 10 is free to fall, under the force of gravity, into the cartridge receiving area 118. A second activation of the plunger 142 will position the second cartridge into the magazine 160 in the same manner as described with regard to the first cartridge. Continued use of the plunger 142 will result in loading cartridges into the magazine 160 until either the magazine 160 is full or there are no more cartridges in the chute 80. When the chute 80 is depleted of cartridges, the handle 60 is manipulated to move the gate 42 so as to align the gate space 70 with another of the spaces 34, 36, 40 so as to allow another plurality of cartridges into the chute 80 for loading into the magazine 160.

As an example, the gate 42 can be moved from the position depicted in FIG. 3 to align the detent 68 with the second notch 66B as depicted in FIG. 2. As a result of this movement, the second spacer 74 relaxes to a position substantially aligned with the third spacer 76 to provide, in cooperation with the third spacer 76 and the lower gate portion 48, a substantially continuous wall for the chute 80 and a substantially continuous series of slots 84, 88, 90 for guidance of the rims, as depicted in FIG. 2. When the gate 42 is in this position, the upper portion 46 of the gate 42 prevents communication between the first slot 34 and the chute 80 while the lower gate portion 48 prevents communication of the third and fourth slots 38, 40 with the chute 80.

When all cartridges in the orienter 10 have been loaded into magazines, the orienter 10 is removed and either replaced with a new orienter containing oriented cartridges or is itself reused to orient a second plurality of cartridges.

When the magazine 160 has been fully loaded, it is removed by rotating the latch 162 and sliding the magazine protrusions (not shown) through the slots 166. The full magazine can then be replaced by an empty or partially empty magazine for further loading.

The manner of operation of the embodiment of the invention depicted in FIGS. 9–15 will now be described. A plurality of cartridges 257, such as 9 millimeter cartridges, are placed on a surface. The collector is detached from the loader by pulling upward on the collector. The collector is placed over one of the cartridges 257*m* with the first end wall 222 of the collector aligned with the nose end of a cartridge. The collector is then pushed down towards the surface over the cartridge. The cartridge 257*m* bears against the latch body 248 causing it to move upward. As described above, such upward movement of the latch body 248 results in movement of the latch body 248 away from the second side wall 228, thus providing for an opening large enough for the cartridge 257*m* to pass through the open end 236 of the collector 210. Upward movement of the cartridge 257*m* and latch body 248 continues until the latch body 248, by the urging of the spring 254, has sufficient clearance to move downward around the cartridge 257*m* to assume the position generally as depicted in FIG. 12 with the cut-out 256 of the latch body 248 cradling and holding in place the lowermost cartridge. This procedure is repeated to collect a number of cartridges 257*a–m* into the holding chamber 230 of the collector which are thus held therein in a oriented condition in which the noses of all the cartridges are adjacent to the first end wall 222 of the collector.

If the loader 212 is already configured to accommodate the shape of the cartridges 257 which have been collected in the collector 210, insertion of the magazine can be next achieved as described below. If the loader 212 is not configured for the shape of the cartridges which have been collected, the configuration of the loader 212 can be changed by replacing the nose piece 324 and/or collector receiving area 262 to provide a nose piece 324 and collector receiving area 262 which have shapes corresponding to the shape of the cartridges 257*a–m* in the collector 210.

A magazine 268 is inserted into the magazine receiving area 264 of the loader and clamped therein by the clamp 266. The collector is inserted into the collector receiving area 262 of the loader 212 causing the latch 248 of the collector to open, as described above, and permit the lowermost of the cartridges 257*m* in the collector 210 to fall downward through the cartridge passageway 368 into the cartridge holding region 370. In this way, the nose portion of the cartridge 257*m* is partially surrounded by the nose hook 324, as depicted in FIG. 14. The handle 260 is grasped and the lever 286 is moved into the recess 290 of the handle 260. As described above, the handle 260 and lever 286 can be grasped by one hand. Furthermore, the lever 286 can be moved into the recess 290 by the same hand, such as with a squeezing movement. Thus, the loading operation can be achieved with one hand. Movement of the lever 286 causes the tooth 292 to move from the position depicted in FIG. 14 towards the second wall of the loader body housing 310. The resultant movement of the slots 332, 334, 354, 356 causes the cartridge engagement piece 320 to move towards the front wall 346 of the housing. Because of the necessity for posts 326, 328 to move within the slots 332, 334, 354, 356 and of the pin 336 to move in the channel 340, the cartridge engagement piece moves substantially without changing the angular relationship of the cartridge engagement piece front wall 372 to the longitudinal axis of the magazine 268. This direction of movement can be roughly described as parallel to the longitudinal axis of the magazine 268, although in fact it may be at some angle to the axis, such as about 20°, as approximately depicted in FIG. 14.

As the cartridge is moved in a direction towards the front wall 346 of the housing, i.e. towards the magazine, it has been found that there is some tendency for the cartridge 257*m* to move away from the cartridge receiving area 370. In particular, there is a tendency for the rear portion (i.e. the portion opposite the nose end of the cartridge) to flip or move upwards. This tendency is limited or eliminated by the second guide ramp 371 which is positioned such that the cartridge 257*m* bears against the underside of the second guide ramp 371 during at least part of the movement of the cartridge 257*m* towards the front wall 346 of the housing. After some amount of movement towards the magazine, the cartridge in the cartridge receiving area 370 will contact the uppermost cartridge 257*n* in the magazine 268. If the magazine 268 is empty, the cartridge 257*m* in the cartridge receiving area 370 will contact the follower of the magazine (not shown). Further movement of the cartridge engagement piece 320 causes the cartridge 257*m* in the cartridge receiving area 370 to press against the uppermost cartridge 257*n* (or the follower). Such pressure creates a tendency for the cartridge being loaded 257*m* to move away from the cartridge holding region 370. Specifically, such pressure causes a torque on the cartridge 257*m* in the cartridge holding region 370 which tends to rotate the cartridge 257*m* around a vertical axis tending to move the nose in a clockwise direction (as viewed in FIG. 14). Actual rotation is limited or prevented by the hookshape of the nose hook 324. If the hook-shape of the nose hook were not present, such as if the nose hook 324 were a flat wall, there would be a tendency for the nose end of the cartridge to slip out of the cartridge holding region 370 and, in some cases, slip underneath the cartridge engagement piece 320, possibly causing jamming. Continued movement of the cartridge engagement piece 320 causes the cartridge 257*m* in the cartridge holding region 370 to move the cartridge 257*n* or cartridges in the magazine 368 towards the bottom 271 of the magazine 268.

It has been found that because of differing configurations of magazine lips 386 in the magazines produced by different manufacturers, there is some tendency of the cartridge 257*m* to strike the lips 386 of some magazines unless the cartridge 257*m* is slightly lifted (i.e. moved in a direction slightly towards the housing body cap 358) before and/or during movement of the cartridge 257*m* towards the magazine and partially through the opened end of the magazine 268. This slight lifting is provided by the first guide ramp 273 which has a surface that is slightly inclined to the direction of movement of the cartridge engagement piece 320. In particular, the first guide ramp 273 is inclined upwards in a direction towards the magazine 268. The total lift or rise provided by the first guide ramp is relatively small, such as, e.g., about 0.02 in, with the objective being to direct the cartridge towards the center of the magazine opening. The desired lift has been found useful to cause proper loading of the cartridges in spite of the differing lip configurations in magazines produced by different manufacturers.

Movement of the cartridge engagement piece 320 towards the magazine 268 continues until the posts 326, 328 are positioned in the forwardmost positions 374, 376 of the slots 332, 334, 354, 356. At this time, the pin 336 has moved past the second interior wall 342 to lie in the second leg of the L-shaped channel 340 and the interior side surface 378 is substantially adjacent to a first side wall 380 of the cartridge engagement piece 320. The slots 332, 334, 354, 356 and channel 340 are configured such that when the cartridge engagement piece 320 has reached the described position, the cartridge is positioned partly in the magazine in a position below the plane defined by the magazine lips 386.

Further movement of the tooth 292 towards the second side wall 310 causes the cartridge engagement piece 320, along with the first and second sliding bodies 300, 302 to move towards the second side wall 310. This movement results in motion of the cartridge, which is in the cartridge receiving area 370, in a second direction, substantially perpendicular to the longitudinal axis of the magazine 268. Movement in this second direction causes the cartridge to move entirely into the open end of the magazine to be positioned beneath the lips 386 of the magazine 268. The cartridge in the cartridge receiving area 370 is continuously contacted by the cartridge engagement piece 320 while moving in the first and second directions.

The lever 286 is then released and the biasing device causes the lever 286 to move to the position depicted in FIG. 15 and thus causes the tooth 292 to move towards the first end wall 308 of the body housing 258. This movement of the tooth 292 causes the motion described above to be reversed and the first and second sliding bodies 300, 302 and cartridge engagement piece 320 returned to the positions depicted in FIG. 14, aligning the cartridge receiving area 370 with the passageway 368 and permitting the next cartridge to fall, under the influence of gravity, from the collector into the cartridge receiving area 370.

The process described above is repeated to place a plurality of cartridges into the magazine 268, preferably to fill the magazine. After cartridges are placed into the magazine 268, the clamp 266 is loosened and the magazine 268 is removed. If cartridges remain in the collector 210, another magazine 268 can be attached to the loader and cartridges placed therein as described above. After the collector 210 is depleted, it can be removed from the loader 212 and more cartridges inserted therein as described above.

As will be apparent to those skilled in the art, although not depicted in the figures, a number of variations on the preferred embodiment can be used. With respect to the orienter, the number of slots and rails can be varied. Communication from the columns to the chute can be controlled in a number of ways including a plurality of individually opened gates, or a gate placed in another position such as the region in which the upper rail portions 24–32A meet the lower rail portions 24–32B. Spacers 72, 74, 76 can be positioned in additional or alternative positions, such as the region in which the upper rail portions 24–32A meet the lower rail portions 24–32B, to assist in guiding cartridge movement.

A number of features which are described as being manually activated can be automatically activated and a number of automatic features can be manually activated. For example, the automatic cam-action opening of the latch and tongue can be accomplished manually. The spring-return of the plunger to its original position can be accomplished manually. The manual selection of gate positions can be accomplished automatically by electronics, levers or other well-known means.

A number of features described as being internally mounted can also be externally mounted, such as the detent 66 and notch 68 gate controller, or the spacers 72, 74, 76.

Movement of cartridges through the opening 92 can be controlled by devices other than the latch 94, such as providing a gate 42 which can prevent all entry of cartridges into the chute 80 until desired.

The particular camming mechanisms 124, 130, 326, 328, 332, 334, 354, 356 described can be modified to provide a different movement of the cartridge into the magazine, such as by providing a different shape or number of cams, cam followers, posts or slots. The movement of the cartridges through the magazine opening, rather than being controlled by cams and slots, can be controlled by a number of other devices known in the art such as gear trains, stepping motors, electronic switches, and the like.

Although the preferred embodiment was described in relation to orienting and loading rim-fire cartridges, many aspects of the invention such as the described loading process and gating of columns to a chute can be usefully employed in connection with orienting, collecting and loading center-fire or rimless cartridges.

Lastly, it should be understood that the orienter and collector of the present invention need not be used with the particular loaders described herein, but could be adapted for use with other mechanisms. Similarly, the loaders need not be used with the particular orienter or collector described herein.

Although the present invention has been described with reference to certain embodiments, it should be appreciated that further modifications can be effected within the spirit and scope of the invention.

What is claimed is:

1. An apparatus for loading a plurality of cartridges into a magazine having an open end, comprising:

holding means for positioning the magazine;

cartridge moving means operably connected to said holding means for moving a first cartridge having a nose portion, said cartridge moving means defining a cartridge holding region and comprising a hook-shaped portion for engaging said nose portion of said first cartridge to limit movement of said first cartridge away from said cartridge holding region.

2. An apparatus, as claimed in claim 1, further comprising:

a guide ramp adjacent to said holding means for lifting said first cartridge while said first cartridge is being moved by said cartridge moving means.

3. An apparatus, as claimed in claim 1, further comprising:

a guide ramp positioned above the cartridge moving means to limit movement of the first cartridge away from said cartridge holding region.

4. An apparatus for loading a plurality of cartridges into a magazine having an open end and with the magazine being adapted to be removably connected to a firearm, the apparatus comprising:

cartridge moving means for moving a first cartridge into the open end of the magazine;

a housing for said cartridge moving means and for receiving cartridges, said housing being different from the magazine, said housing including at least a partially hollow handle having a longitudinal extent and a size for gripping by the hand of the user;

lever means attached to and movable with respect to said handle, said lever means at least partially received within said partially hollow handle along said longitudinal extent thereof to be positionable with respect to said handle wherein said lever means can be moved into and out of said partially hollow handle using the same hand which holds said handle, said lever means being operatively engageable with said cartridge moving means wherein said movement of said lever means results in movement of said cartridge moving means; and wherein none of said cartridge moving means, said housing and said lever means are adapted to be connected to the firearm and none of said cartridge moving means, said housing and said lever means house a plurality of cartridges.

5. An apparatus for loading a plurality of cartridges into a magazine having an open end and a second end opposite said open end, comprising:

cartridge moving means for moving a first cartridge into the open end of the magazine;

magazine holding means for positioning the magazine to receive at least said first cartridge; and clamp means comprising a pressure pad attached to a screw device which is adjustable to position said pressure pad adjacent to the second end of the magazine such that the magazine is releasably secured in said magazine holding means.

6. A collector for collecting cartridges, comprising:

a holding portion having first and second end walls and first and second side walls defining a holding chamber having at least one open end, said open end having a length defined by a distance between said first and second end walls, said length being greater than the length of each cartridge received by said holding portion and wherein the length of each cartridge is substantially perpendicular to said end walls while being held in said holding portion;

latch means at least partially covering said open end and movable with respect to said open end wherein said latch means is movable to permit passage of a first of the cartridges through said open end in a first direction by pushing said open end of said holding portion down over the first cartridge and wherein said latch means is movable to permit movement of at least one cartridge through said open end in a second direction.

7. A collector, as claimed in claim 6, wherein:

said latch means includes a slidably movable portion constructed and arranged to be biased into a first position wherein the cartridges are held from movement in said second direction.

8. An apparatus for collecting and loading a plurality of cartridges into a magazine having an open end, comprising:

a collector for collecting cartridges, said collector having a holding portion with at least one open end and a latch at least partially covering said open end and slidably movable relative to said holding portion to permit passage of a first of the cartridges through said open end in a first direction when said collector is pushed down over the first cartridge;

a loader having cartridge moving means for moving the first cartridge into the open end of the magazine; and collector receiving means in said loader for receiving said collector, wherein said collector receiving means engages said slidably movable latch to slidably move said latch relative to said holding portion into an open position to supply at least the first cartridge to said cartridge moving means.

9. An apparatus for collecting and loading a plurality of cartridges into a magazine having an open end, comprising:

a collector for collecting cartridges having a holding portion with at least one open end and a latch at least partially covering the open end and movable to permit passage of a first of the cartridges through said open end in a first direction when said collector is pushed down over the first cartridge;

means for moving said latch of said collector to permit movement of at least the first cartridge in a second direction through said open end;

a loader having cartridge moving means for moving the first cartridge into the open end of the magazine; and collector receiving means in said loader for receiving said collector in a position to supply at least the first cartridge to said cartridge moving means.

10. An apparatus for loading a plurality of cartridges into a magazine having a longitudinal axis, the magazine having an opening elongated in a direction substantially perpendicular to the longitudinal axis of the magazine, the apparatus comprising:

a housing comprising a forward wall, a rear wall, a first side wall and a second side wall, said forward wall, rear wall, first side wall and second side wall defining a cavity;

a magazine receiving area for holding the magazine with the opening adjacent to said forward wall;

a sliding body disposed within said cavity for linearly sliding in a first direction from a first position to a second position and from said second position to a third position, said sliding body having at least one slot elongated in a direction at an angle to said direction of sliding, said slot having first and second ends;

a cartridge engagement piece disposed in said cavity and slidable with respect to said sliding body, said cartridge engagement piece having a post positioned to fit in said slot:

wherein when said sliding body moves from said first position to said second position, said post moves from a location adjacent to said first end of said slot to a location adjacent to said second end of said slot and said cartridge engagement piece moves at an angle to the direction of elongation of the magazine opening; and wherein when said sliding body moves from said second position to said third position, said sliding body engages said cartridge engagement piece to move said cartridge engagement piece in a direction substantially parallel to the direction of elongation of the magazine opening;

a handle with a movable portion, said movable portion operatively engaged with said sliding body to move said sliding body from said first position to said second position and from said second position to said third position wherein said cartridge engagement piece moves in a direction at an angle to the direction of elongation of the magazine opening and then in a direction substantially parallel to the direction of elongation of the magazine opening.

11. A method for loading a plurality of cartridges into a magazine having a longitudinal axis and an opening, the opening being elongated in a direction perpendicular to the longitudinal axis, the method comprising:

providing a loader housing comprising a forward wall, a rear wall, a first side wall and a second side wall defining a cavity;

securing the magazine in a position with the magazine opening adjacent to said forward wall;

providing a sliding body disposed in said cavity for linearly sliding movement in a first direction and having a slot with first and second ends elongated in a direction at an angle to said first direction;

providing a cartridge engagement piece in said cavity defining a cartridge holding region, slidable with respect to said sliding body and having a post positioned to fit in said slot;

providing a handle attached to said housing with a movable portion operatively engaged with said sliding body to move said sliding body;

providing a cartridge in said cartridge holding region;

moving said movable portion to move said sliding body from a first position to a second position wherein said post moves from said first end of said slot to said second end of said slot, moving said cartridge engagement piece to translate said cartridge in a first direction at an angle to the direction of elongation of the magazine opening;

moving said movable portion to move said sliding body from said second position to said third position wherein said sliding body engages said cartridge engagement piece to move said cartridge engagement piece and translate said cartridge in a direction substantially parallel to the direction of elongation of the magazine opening.

12. A kit for adapting a loading apparatus for use with a particular shape of cartridge, the loading apparatus having a nose hook socket and a collector receiving area socket, the kit comprising:

a nose hook having a hook configuration corresponding to the contour of at least a portion of the particular shape of the cartridge and attachment means configured to fit in and be held securely by the nose hook socket of the loader; and a collector receiving area having a passageway of a shape corresponding to the shape of at least a portion of the particular shape of the cartridge and attachment means configured to fit in and be held securely by the collector receiving area socket of the loader.

13. An apparatus for loading a plurality of cartridges into a magazine having an open end, comprising:

a housing;

holding means for securing the magazine with respect to said housing;

sliding body means disposed within said housing; and a cartridge engagement piece operatively connected to said sliding body means wherein, when said sliding body means slides in a first direction from a first position to a second position, said cartridge engagement piece moves in a second direction, and when said sliding body means continues to move in said first direction from said second position to a third position, said cartridge engagement piece moves in a direction different from said second direction to load one of the cartridges into the open end of the magazine.

14. A kit for adapting a loading apparatus for use with a particular shape of a cartridge, the loading apparatus having a nose hook socket, the kit comprising:

a nose hook having a hook configuration corresponding to the contour of at least a portion of the particular shape of the cartridge and attachment means configured to fit in and be held securely by the nose hook socket of the loader.

* * * * *